US009598921B2

(12) United States Patent
Heijnen et al.

(10) Patent No.: US 9,598,921 B2
(45) Date of Patent: Mar. 21, 2017

(54) METHOD AND SYSTEM FOR WELL AND RESERVOIR MANAGEMENT IN OPEN HOLE COMPLETIONS AS WELL AS METHOD AND SYSTEM FOR PRODUCING CRUDE OIL

(75) Inventors: Wilhelmus Hubertus Paulus Maria Heijnen, Stromberg (DE); Robert Bouke Peters, Aberdeen (GB); David Ian Brink, Houston, TX (US)

(73) Assignee: MAERSK OLIE OG GAS A/S, COPENHAGEN K (DK)

( * ) Notice: Subject to any disclaimer, the term of this patent is extended or adjusted under 35 U.S.C. 154(b) by 799 days.

(21) Appl. No.: 14/002,918

(22) PCT Filed: Feb. 14, 2012

(86) PCT No.: PCT/EP2012/052447

§ 371 (c)(1),
(2), (4) Date: Nov. 11, 2013

(87) PCT Pub. No.: WO2012/119837

PCT Pub. Date: Sep. 13, 2012

(65) Prior Publication Data

US 2014/0054031 A1 Feb. 27, 2014

Related U.S. Application Data

(60) Provisional application No. 61/450,326, filed on Mar. 8, 2011.

(30) Foreign Application Priority Data

Mar. 4, 2011 (DK) ..... 2011 70110

(51) Int. Cl.
*E21B 23/14* (2006.01)
*E21B 33/12* (2006.01)
(Continued)

(52) U.S. Cl.
CPC ..... *E21B 23/14* (2013.01); *E21B 4/18* (2013.01); *E21B 23/06* (2013.01); *E21B 33/126* (2013.01);
(Continued)

(58) Field of Classification Search
CPC ..... E21B 43/103; E21B 43/108; E21B 43/08; E21B 33/127; E21B 33/128; E21B 2023/008; E21B 47/10; E21B 47/1025
See application file for complete search history.

(56) References Cited

U.S. PATENT DOCUMENTS 2,122,697 A 7/1938 Potter
2,271,005 A 1/1942 Grebe
(Continued)

FOREIGN PATENT DOCUMENTS

DE 2358371 A1 5/1975
EP 1223305 A2 7/2002
(Continued)

OTHER PUBLICATIONS

Search Report for Danish Application No. PA 2009 70180, completed Jun. 3, 2010.
(Continued)

*Primary Examiner* — Michael Wills, III
(74) *Attorney, Agent, or Firm* — Brinks Gilson & Lione

(57) ABSTRACT

According to the method for well and reservoir management in open hole completions, a data acquisition module (100) is advanced through the wellbore and acquires data providing information revealing fractures in the wall of the wellbore, and at least one blocking system (1002, 3000), on the basis of the data acquired, is placed in the wellbore(199, 2199, 3006) at the location of a fracture in the wall. The data acquisition module (100) is advanced by interaction with a fluid present in the wellbore, and the data acquisition module
(Continued)

acquires data providing information on its own position in relation to the wall (3005) of the wellbore (199, 2199, 3006) and is controlled on the basis of said data in order to maintain a distance to the wall of the wellbore during its advancement. A system for well and reservoir management in open hole completions is further disclosed.

30 Claims, 21 Drawing Sheets

(51) Int. Cl.

| | |
|---|---|
| ***E21B 47/10*** | (2012.01) |
| ***E21B 23/06*** | (2006.01) |
| ***E21B 4/18*** | (2006.01) |
| ***E21B 33/126*** | (2006.01) |
| *E21B 23/00* | (2006.01) |

(52) U.S. Cl.
CPC ..... *E21B 33/1208* (2013.01); *E21B 47/10* (2013.01); *E21B 2023/008* (2013.01)

(56) References Cited

U.S. PATENT DOCUMENTS

| | | | |
|---|---|---|---|
| 3,926,254 | A | 12/1975 | Evans et al. |
| 3,937,278 | A | 2/1976 | Sheshtawy |
| 4,320,800 | A | 3/1982 | Upchurch |
| 4,365,676 | A | 12/1982 | Boyadjieff et al. |
| 4,372,161 | A | 2/1983 | De et al. |
| 4,611,405 | A | 9/1986 | Van Steenwyk |
| 4,621,532 | A | 11/1986 | Takagi et al. |
| 4,919,223 | A | 4/1990 | Egger et al. |
| 5,070,941 | A | 12/1991 | Kilgore |
| 5,558,153 | A | 9/1996 | Holcombe et al. |
| 5,758,731 | A | 6/1998 | Zollinger |
| 5,955,666 | A | 9/1999 | Mullins |
| 6,241,028 | B1 | 6/2001 | Bijleveld |
| 6,241,031 | B1 | 6/2001 | Beaufort et al. |
| 6,253,850 | B1 | 7/2001 | Nazzal et al. |
| 6,478,097 | B2 | 11/2002 | Bloom et al. |
| 6,679,341 | B2 | 1/2004 | Bloom et al. |
| 6,845,819 | B2 | 1/2005 | Barrett et al. |
| 7,059,417 | B2 | 6/2006 | Moore et al. |
| 7,080,700 | B2 | 7/2006 | Bloom et al. |
| 7,174,974 | B2 | 2/2007 | Bloom et al. |
| 7,188,681 | B2 | 3/2007 | Bloom et al. |
| 7,230,541 | B2 | 6/2007 | Ripolone et al. |
| 7,353,886 | B2 | 4/2008 | Bloom et al. |
| 7,392,859 | B2 | 7/2008 | Mock et al. |
| 7,493,967 | B2 | 2/2009 | Mock et al. |
| 7,607,495 | B2 | 10/2009 | Bloom et al. |
| 7,607,497 | B2 | 10/2009 | Mock et al. |
| 7,954,563 | B2 | 6/2011 | Mock et al. |
| 8,069,917 | B2 | 12/2011 | Bloom et al. |
| 8,109,331 | B2 | 2/2012 | Lynde et al. |
| 8,151,902 | B2 | 4/2012 | Lynde et al. |
| 8,245,796 | B2 | 8/2012 | Mock et al. |
| 8,430,810 | B2 | 4/2013 | Hassidov et al. |
| 8,555,963 | B2 | 10/2013 | Bloom et al. |
| 8,602,115 | B2 | 12/2013 | Aguirre et al. |
| 2001/0045300 | A1 | 11/2001 | Fincher et al. |
| 2002/0007971 | A1 | 1/2002 | Beaufort et al. |
| 2002/0029908 | A1 | 3/2002 | Bloom et al. |
| 2002/0088648 | A1 | 7/2002 | Krueger et al. |
| 2002/0096322 | A1 | 7/2002 | Barrett et al. |
| 2002/0112859 | A1 | 8/2002 | Bloom et al. |
| 2002/0190682 | A1 | 12/2002 | Schempf et al. |
| 2003/0102164 | A1 | 6/2003 | Odell, II et al. |
| 2003/0192707 | A1 | 10/2003 | Guven et al. |
| 2004/0065445 | A1 | 4/2004 | Simpson et al. |
| 2004/0090230 | A1 | 5/2004 | Appel et al. |
| 2004/0144548 | A1 | 7/2004 | Bloom et al. |
| 2004/0182580 | A1 | 9/2004 | Moore et al. |
| 2004/0226746 | A1 | 11/2004 | Schmidt et al. |
| 2004/0226747 | A1 | 11/2004 | Stegmaier et al. |
| 2004/0262008 | A1 | 12/2004 | Deans et al. |
| 2005/0150692 | A1 | 7/2005 | Ballantyne et al. |
| 2005/0262944 | A1 | 12/2005 | Bennett et al. |
| 2006/0180316 | A1 | 8/2006 | Steele et al. |
| 2006/0196694 | A1 | 9/2006 | Bloom et al. |
| 2007/0000693 | A1 | 1/2007 | Bloom et al. |
| 2007/0256861 | A1 | 11/2007 | Hulick |
| 2008/0066963 | A1 | 3/2008 | Sheiretov et al. |
| 2008/0073077 | A1 | 3/2008 | Tunc et al. |
| 2008/0121429 | A1 | 5/2008 | Bamford |
| 2008/0159077 | A1 | 7/2008 | Madhavan et al. |
| 2008/0211687 | A1 | 9/2008 | Price et al. |
| 2008/0217059 | A1 | 9/2008 | Bloom et al. |
| 2008/0308318 | A1 | 12/2008 | Moore |
| 2009/0200290 | A1 | 8/2009 | Cardinal et al. |
| 2009/0205840 | A1 | 8/2009 | O'Connor et al. |
| 2009/0211754 | A1 | 8/2009 | Verret et al. |
| 2009/0218105 | A1 | 9/2009 | Hill et al. |
| 2010/0126716 | A1 | 5/2010 | Joseph |
| 2010/0133006 | A1 | 6/2010 | Shakra et al. |
| 2011/0067926 | A1 | 3/2011 | Moore |
| 2012/0024539 | A1 | 2/2012 | Lehr |
| 2012/0292049 | A1 | 11/2012 | Heijnen et al. |
| 2014/0054031 | A1 | 2/2014 | Heijnen et al. |

FOREIGN PATENT DOCUMENTS

| | | | |
|---|---|---|---|
| FR | 1561771 | A | 3/1969 |
| GB | 2234278 | A | 1/1991 |
| GB | 2275066 | A | 8/1994 |
| GB | 2368082 | A | 4/2002 |
| WO | 9812418 | | 3/1998 |
| WO | 0036266 | | 6/2000 |
| WO | 02070943 | A2 | 9/2002 |
| WO | 2008024881 | A1 | 2/2008 |

OTHER PUBLICATIONS

PCT International-Type Search Report for DK 200901032, dated Apr. 7, 2010,4 pages.

Search Report for Application No. PA 200901032, dated Apr. 13, 2010, 1 page.

International Search Report for International Application No. PCT/EP2010/066376, dated Dec. 8, 2010.

International Search Report for corresponding International application No. PCT/EP2010/068762, dated Feb. 7, 2011.

Written Opinion of the International Searching Authority for corresponding International application No. PCT/EP2010/068762, dated Feb. 7, 2011.

International Search Report for PCT/EP2010/066233, mailed Feb. 16, 2011.

Written opinion for PCT/EP2010/066233, mailed Feb. 16, 2011.

Search Report for DK application PA 2011 70110, Nov. 7, 2011.

International Preliminary Report on Patentability for corresponding International application No. PCT/EP2010/068762, dated Nov. 17, 2011.

International Preliminary Report on Patentability for International Application No. PCT/EP2010/066376, dated Nov. 30, 2011.

Supplemental Search Report for DK application PA_2011_70110, Apr. 16, 2013.

"The Development of Novel Down-Hole Intervention Tools, a Change in Well Technology (SPE 122822)," Proceedings of Offshore Europe, Sep. 8, 2009 (Sep. 8, 2009), pp. 1-14, XP055061112, DOI: 10.2118/122822-MS ISBN: 978-1-55-563261-8, the whole document.

PCT/EP2012/052447 International Search Report and Written Opinion, mailed May 7, 2013.

METHOD AND SYSTEM FOR WELL AND RESERVOIR MANAGEMENT IN OPEN HOLE COMPLETIONS AS WELL AS METHOD AND SYSTEM FOR PRODUCING CRUDE OIL

RELATED APPLICATIONS

This application claims the benefit under 35 U.S.C. §371 of International Patent Application No. PCT/EP2012/052447, having an international filing date of Feb. 14, 2012, which claims priority to Danish Patent Application No. PA 2011 70110, filed Mar. 4, 2011, and U.S. Provisional Application No. 61/450,326, filed Mar. 8, 2011, the contents of all of which are incorporated herein by reference in their entirety.

BACKGROUND OF THE INVENTION

Field of the Invention

The present invention relates to a method for well and reservoir management in open hole completions, whereby a data acquisition module is advanced through a wellbore and acquires data providing information revealing fractures in a wall of the wellbore, and whereby at least one blocking system, on the basis of the data acquired, is placed in the wellbore at the location of a fracture in the wall.

Description of Related Art

In order to find and produce hydrocarbons e.g. petroleum oil or gas hydrocarbons such as paraffin's, naphthenes, aromatics and asphaltics or gases such as methane, a well may be drilled in rock (or other) formations in the Earth.

After the well bore has been drilled in the earth formation, a well tubular may be introduced into the well. The well tubular covering the producing or injecting part of the earth formation is called the production liner. Tubulars used to ensure pressure and fluid integrity of the total well are called casing. Tubulars which bring the fluid in or from the earth formation are called tubing. The outside diameter of the liner is smaller than the inside diameter of the well bore covering the producing or injecting section of the well, providing thereby an annular space, or annulus, between the liner and the well bore, which consists of the earth formation. This annular space can be filled with cement preventing axial flow along the casing. However if fluids need to enter or leave the well, small holes will be made penetrating the wall of the casing and the cement in the annulus therewith allowing fluid and pressure communication between the earth formation and the well. The holes are called perforations. This design is known in the oil and natural gas industry as a cased hole completion.

An alternative way to allow fluid access from and to the earth formation can be made, a so called open hole completion. This means that the well does not have an annulus filled with cement but still has a liner installed in the earth formation. The latter design is used to prevent the collapse of the bore hole. Yet another design is when the earth formation is deemed not to collapse with time, then the well does not have a casing covering the earth formation where fluids are produced from. When used in horizontal wells, an uncased reservoir section may be installed in the last drilled part of the well. The well designs discussed here can be applied to vertical, horizontal and/or deviated well trajectories.

To produce hydrocarbons from an oil or natural gas well, a method of water-flooding may be utilized. In water-flooding, wells may be drilled in a pattern which alternates between injector and producer wells. Water is injected into the injector wells, whereby oil in the production zone is displaced into the adjacent producer wells.

The water pressure required in order to push the oil into the producer wells must overcome the fluid friction losses in the earth formation between injector and producer and must overcome the reservoir pressure minus the hydrostatic head of the injection fluid. The water pressure, possibly combined with a low water temperature e.g. in the order of 5 degrees C., can induce fractures in the rock of the reservoir formation. If a fracture extends from an injector well to a producer well, it may form a channel through which water may be conveyed directly from the injector well to the producer well therewith not pushing the oil or gas in front of the water to the oil or gas production well.

Water may also be conveyed through naturally occurring fractures in the earth formation and thereby not push the oil to the producing well.

Knowledge of the position of such water bearing fractures may in the prior art be determined by conveying a suite of petrophysical tools in the well to determine where water is located. This can be done in an open hole completion or after cementing a liner in the open hole.

However, cementing a liner in an open hole completion may be associated with a number of technical problems, such as for example: 1) the liner may run into an existing side track or a leg of a fishbone well; 2) cementation of the liner cannot be carried out due to losses; 3) the cementation causes fractures in the reservoir creating a connection to another well.

Conveying petrophysical tools into wells, especially horizontal wells is limited to the depth that can be reached with any means of conveyance suitable for particular well dimensions.

Thus, it may be advantageous to be able to identify such water bearing fractures without cementing a liner into the open hole completion and without having to convey petrophysical logging tools into horizontal wells by conventional means.

U.S. Pat. No. 6,241,028 disclose a method and system for measuring data in a fluid transportation conduit, such as a well for the production of oil and/or gas. The system employs one or more miniature sensing devices which comprise sensing equipment that is contained in a preferably spherical nut-shell. However, horizontal wells need not be straight, and further, wells may contain obstructions such as wash-outs and/or well side tracks, e.g. in fishbone wells. Such conditions may prevent the above system from examining the entire well.

In fact, a horizontal, open hole completion well can comprise a main bore or a main bore with wanted side tracks (fishbone well) or a main bore with unwanted/unknown side tracks.

Further, a horizontal, open hole completion well may, when producing hydrocarbons (producer well) or when being injected with water (injector well) be larger than the original drilled size due to wear and tear.

Additionally, horizontal, open hole completion wells can have wash outs and/or cave ins.

Thus, a need exists to characterize also open hole completion wells in order to seal off parts of the wall of the wellbore where fractures exists. The characterization may comprise e.g. measurement versus depth or time, or both, of one or more physical quantities in or around a well.

In order to determine such characteristics of an open hole completion, wire-line logging may be utilized. Wire-line logging may comprise a tractor which is moved down the open hole completion during which data is logged e.g. by sensors on the tractor.

However, an open hole completion may comprise soft and/or poorly consolidated formations which may pose a problem for existing tractor technologies. For example, chain tracked tractors may impact the wall of soft and/or poorly consolidated formations with too large a force, and tractors comprising gripping mechanisms may rip of pieces of the soft and/or poorly open hole completion wall. A further problem of tractors comprising gripping mechanisms is the restriction in outer diameter, due to the drilled well, of the tractor which may restrict the length and mechanical properties of the gripping mechanisms.

A further problem of the existing tractor technologies with respect to e.g. horizontal open hole completion wells is that the open hole completion may have a diameter varying from a nominal inner diameter such as 8.5 inch of the cased completion hole due to e.g. wash-outs and/or cave ins.

BRIEF SUMMARY OF THE INVENTION

The object of the present invention is to facilitate the exploration of wellbores of different type in connection with the sealing of fractures in the wall of the wellbore.

In view of this object, the method is characterized by that the data acquisition module is advanced by interaction with a fluid present in the wellbore, and by that the data acquisition module acquires data providing information on its own position in relation to the wall of the wellbore and is controlled on the basis of said data in order to maintain a distance to the wall of the wellbore during its advancement.

In this way, the data acquisition module may advance gently through the wellbore without interfering with the wall of the wellbore or getting trapped in cave ins, as the data acquisition module automatically may seek to maintain a distance to the walls of the wellbore and therefore perform its advancement through the wellbore in the central part of the wellbore. Thereby it is also facilitated that the data acquisition module may travel in a wellbore having a diameter substantially larger that an outer maximum diameter of the data acquisition module itself which may be an advantage if for instance the data acquisition module has to travel through tubing having rather small diameter in order to reach a part of the wellbore having larger diameter.

In an embodiment, the data acquisition module is advanced through the wellbore a first and a second time, and during the second time of advancement, the data acquisition module is advanced through at least one blocking system placed in the wellbore. Thereby, it is possible to explore a wellbore already provided with a blocking system in order to place a further blocking system.

In an embodiment, the data acquisition module is advanced in the wellbore at least partly by means of movement of liquid flowing through the wellbore. Thereby, the data acquisition module may simply be advanced by means of pumping fluid into the wellbore or by means of fluid flowing out from the wellbore.

In an embodiment, the data acquisition module is advanced in the wellbore at least partly by means of a propulsion device incorporated into the data acquisition module.

In an embodiment, controlled radial movement of the data acquisition module relative to the wellbore is established at least partly by means of at least one propeller or at least one jet stream. Thereby, a quick response may be obtained in order to move the data acquisition module in radial direction so that interference with the wall of the wellbore may efficiently be avoided.

In an embodiment, controlled vertical movement of the data acquisition module relative to the wellbore is established at least partly by a variable buoyancy system incorporated into the data acquisition module. Thereby, an effective response may be obtained in order to move the data acquisition module in vertical direction, so that interference with the wall of the wellbore may efficiently be avoided.

In an embodiment, data providing information revealing the position along the wellbore of a fracture in the wall of the wellbore is communicated wirelessly to a control module outside the wellbore, and the at least one blocking system is placed in the wellbore at the location of the fracture in the wall on the basis of the data received by said control module. Thereby, the data acquired may be retrieved outside the wellbore although the data acquisition module should not be retrievable itself. Said data may be processed outside the wellbore and/or communicated to another tool or device than the data acquisition module for sealing of a part of the wall of the wellbore.

In an embodiment, a sound signal is communicated between the data acquisition module and a control module located outside the wellbore, whereby the sound signal is transmitted through the fluid present in the wellbore, and the position of a fracture in the wall of the wellbore is determined at least on the basis of said sound signal received by the control module or by the data acquisition module and at least on the basis of a time difference between the time of emission of the sound signal and the time of reception of the sound signal. Thereby, the position of a fracture in the wall of the wellbore may be determined rather accurately and possibly at the same time be wirelessly communicated to a location outside the wellbore.

In an embodiment, data providing information revealing the position along the wellbore of a fracture in the wall of the wellbore is communicated outside the wellbore by means of a radio-frequency identification (RFID) tag released by the data acquisition module, conveyed by the fluid present in the wellbore and collected outside the wellbore. Thereby, the position of a fracture in the wall of the wellbore may be communicated to a location outside the wellbore, even if traditional wireless communication should be impeded by, for instance, environmental conditions.

In an embodiment, the at least one blocking system, on the basis of at least the data acquired by the data acquisition module, is placed in the wellbore at the location of a fracture in the wall by means of a well tractor. Thereby, the blocking system may be placed even at locations hard to reach by traditional means such as for instance coiled tubing.

In an embodiment, a sound signal is communicated between the well tractor and a control module located outside the wellbore, whereby the sound signal is transmitted through the fluid present in the wellbore, and the position of the well tractor is determined at least on the basis of said sound signal received by the control module or by the well tractor and at least on the basis of a time difference between the time of emission of the sound signal and the time of reception of the sound signal. Thereby, the position of the well tractor may be controlled rather precisely in order for the well tractor to reach the correct location in the wellbore where a blocking system should be placed.

In an embodiment, the well tractor pulls the at least one blocking system in the form of a patch through the wellbore to the location of a fracture in the wall, whereby the patch is expanded until abutment against the wall of the wellbore and released from the well tractor. Thereby, even very long patches may be conveyed by means of the well tractor without the risk of the patch getting caught in the wellbore.

In an embodiment, the well tractor advances through a first patch already expanded and fixed in the wellbore and pulls a second patch through the first patch. Thereby it is facilitated that even very long patches may be placed downstream an already placed patch in a wellbore.

In an embodiment, the data acquisition module advances through a first part of the wellbore in order to reach a second part of the wellbore, the at least one blocking system is placed in the second part of the wellbore, and the first part of the wellbore has a diameter that is smaller than, and preferably less than the half of, the diameter of the second part of the wellbore.

The present invention further relates to a system for well and reservoir management in open hole completions, the system comprising a data acquisition module adapted to be advanced through a wellbore and adapted to acquire data providing information revealing fractures in a wall of the wellbore, and the system comprising at least one blocking system and a tool adapted to, on the basis of the data acquired, place the at least one blocking system in the wellbore at the location of a fracture in the wall.

The system is characterized in that the data acquisition module is adapted to be advanced by interaction with the fluid present in the wellbore, and in that the data acquisition module is adapted to acquire data providing information on its own position in relation to the wall of the wellbore and is adapted to be controlled on the basis of said data in order to maintain a distance to the wall of the wellbore during its advancement. Thereby, the above-mentioned features may be obtained.

In an embodiment, the at least one blocking system has the form of a patch adapted to be expanded from a collapsed state to an expanded state for abutment against the wall of the wellbore and fixation in the wellbore, and the data acquisition module has a maximum outer diameter that is smaller than a minimum inner diameter of the at least one patch in its expanded state. Thereby, the above-mentioned features may be obtained.

In an embodiment, the data acquisition module is adapted to be advanced in the wellbore at least partly by means of movement of liquid flowing through the wellbore. Thereby, the above-mentioned features may be obtained.

In an embodiment, the data acquisition module comprises a propulsion device. Thereby, the above-mentioned features may be obtained.

In an embodiment, the data acquisition module comprises at least one propeller or at least one jet stream adapted for controlled radial movement of the data acquisition module relatively to the wellbore. Thereby, the above-mentioned features may be obtained.

In an embodiment, the data acquisition module comprises a variable buoyancy system adapted for controlled vertical movement of the data acquisition module relative to the wellbore. Thereby, the above-mentioned features may be obtained.

In an embodiment, the system comprises a control module adapted to be located outside the wellbore and adapted to receive wirelessly communicated data providing information revealing the position along the wellbore of a fracture in the wall of the wellbore, and the system comprises a tool adapted to place the at least one blocking system in the wellbore at the location of the fracture in the wall on the basis of the data received by said control module. Thereby, the above-mentioned features may be obtained.

In an embodiment, the system comprises a control module adapted to be located outside the wellbore, the system is adapted to communicate a sound signal between the data acquisition module and the control module, whereby the sound signal is transmitted through the fluid present in the wellbore, and the system is adapted to determine the position of a fracture in the wall of the wellbore at least on the basis of said sound signal received by the control module or by the data acquisition module and at least on the basis of a time difference between the time of emission of the sound signal and the time of reception of the sound signal. Thereby, the above-mentioned features may be obtained.

In an embodiment, the data acquisition module is adapted to carry a number of radio-frequency identification (RFID) tags, to code said radio-frequency identification tags with data providing information revealing the position along the wellbore of a fracture in the wall of the wellbore, and to release said radio-frequency identification tags one by one during advancement of the data acquisition module through the wellbore. Thereby, the above-mentioned features may be obtained.

In an embodiment, the tool adapted to place the at least one blocking system in the wellbore is a well tractor. Thereby, the above-mentioned features may be obtained.

In an embodiment, the system is adapted to communicate a sound signal between the well tractor and a control module located outside the wellbore, whereby the sound signal is transmitted through the fluid present in the wellbore, and the system is adapted to determine the position of the well tractor at least on the basis of said sound signal received by the control module or by the well tractor and at least on the basis of a time difference between the time of emission of the sound signal and the time of reception of the sound signal. Thereby, the above-mentioned features may be obtained.

In an embodiment, the well tractor is adapted to pull the at least one blocking system in the form of a patch through the wellbore to the location of a fracture in the wall, and the system is adapted to expand the patch until abutment against the wall of the wellbore and to release the patch from the well tractor. Thereby, the above-mentioned features may be obtained.

In an embodiment, the system comprises at least a first and a second patch, and the well tractor is adapted to advance through the first patch already being expanded and fixed in the wellbore and to subsequently pull the second patch through the first patch. Thereby, the above-mentioned features may be obtained.

In an embodiment, the system comprises a tubing adapted to form a first part of a wellbore, said wellbore having a second part with a diameter that is larger than, and preferably more than twice, the diameter of the first part, and the data acquisition module is adapted to advance through said tubing forming the first part of the wellbore in order to reach the second part of the wellbore and advance through the second part of the wellbore. Thereby, the above-mentioned features may be obtained.

BRIEF DESCRIPTION OF THE SEVERAL VIEWS OF THE DRAWING(S)

The invention will now be explained in more detail below by means of examples of embodiments with reference to the very schematic drawing, in which FIG. 1 shows a sectional view of an embodiment of a data acquisition module in the form of a device 100 for examining a tubular channel comprising a first, a second and a third part.

Figure 20:
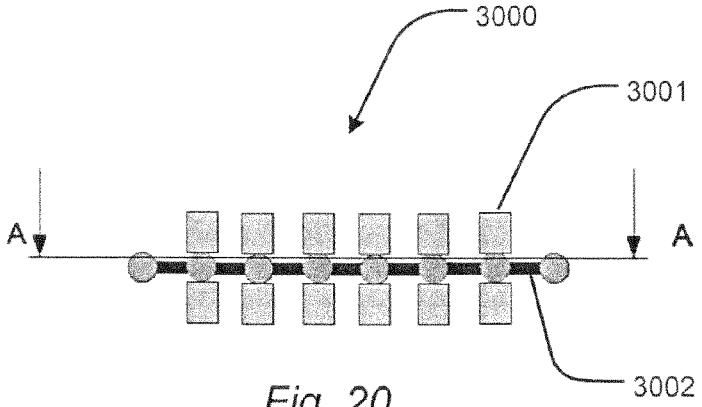

FIG. 20 schematically shows a part of a net or cage of elongate members where the elongate members are connected via intermediate links being able to rotate therewith increasing the distance between the elongate members, the part of the net is seen from an end.

Figure 21:
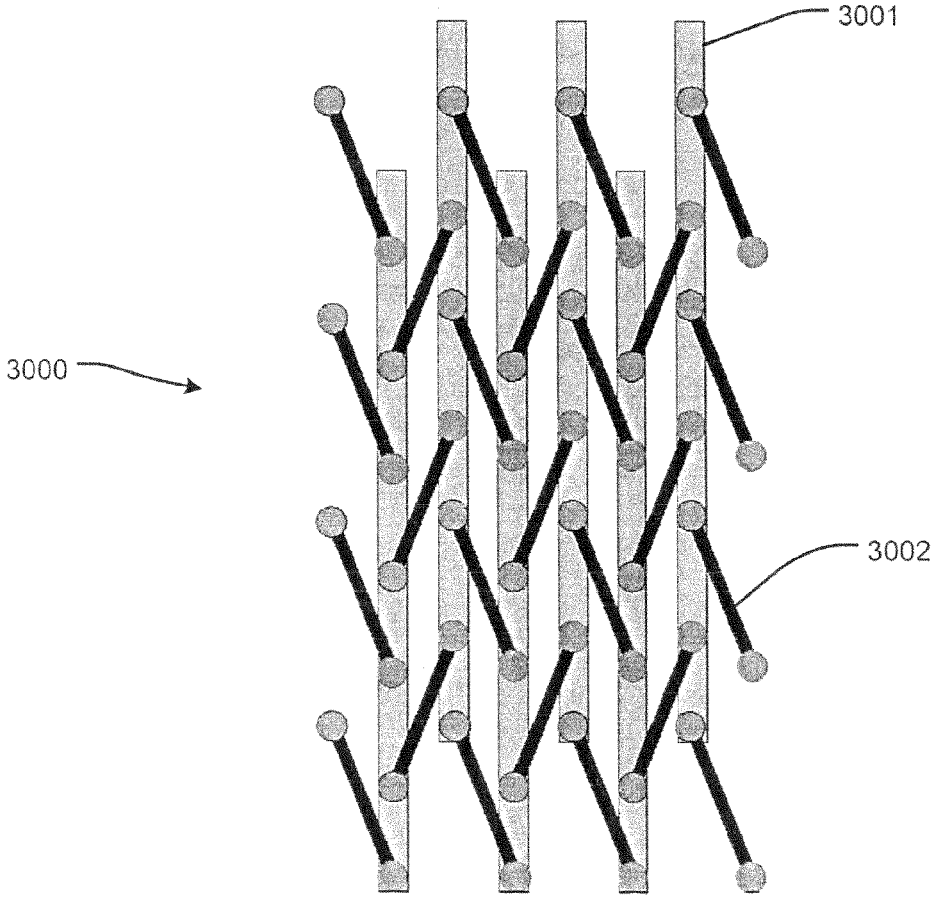

FIG. 21 schematically shows the net or cage in FIG. 20 seen in sectional view A-A.

Figure 22:
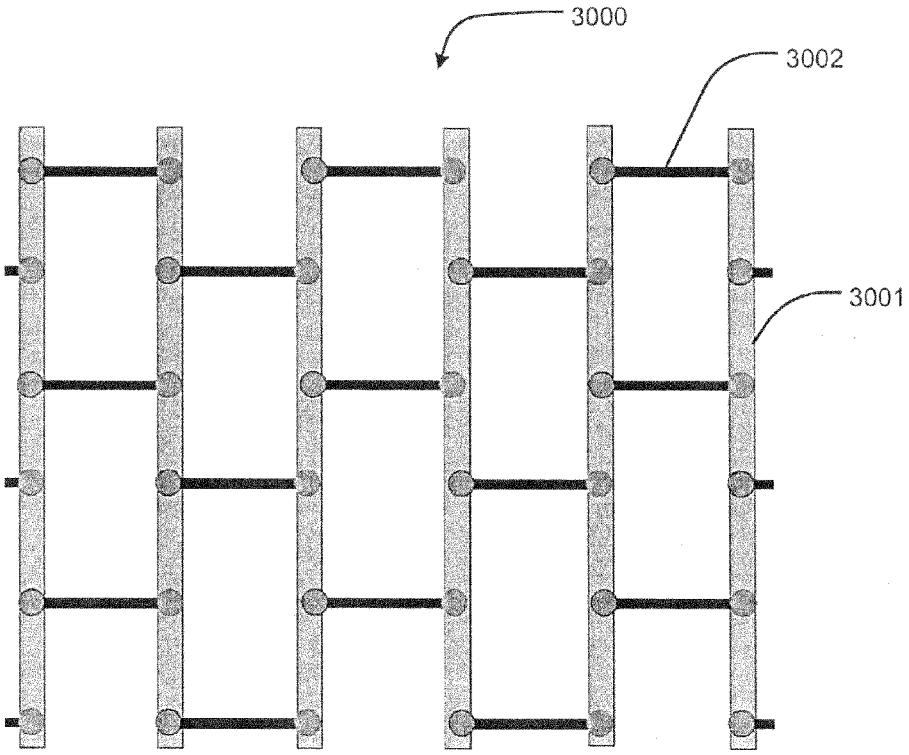

FIG. 22 schematically shows a part of the net in FIGS. 20 and 21 in an expanded position.

Figure 23:
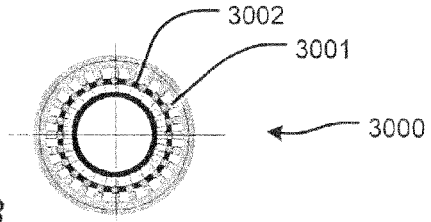

FIG. 23 schematically shows an assembled net or cage in collapsed position.

Figure 24:
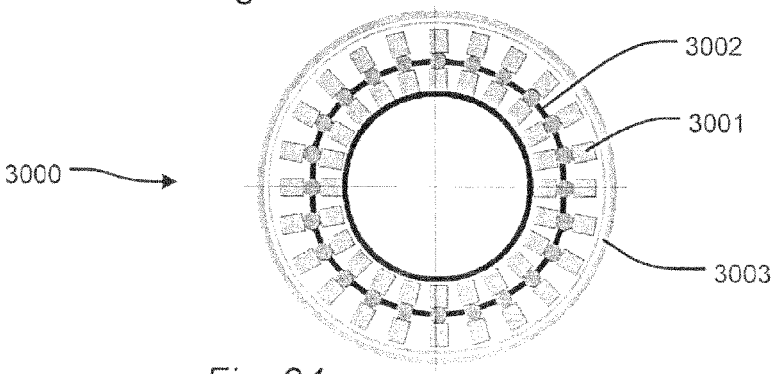

FIG. 24 schematically shows a net or cage in expanded position.

Figure 25:
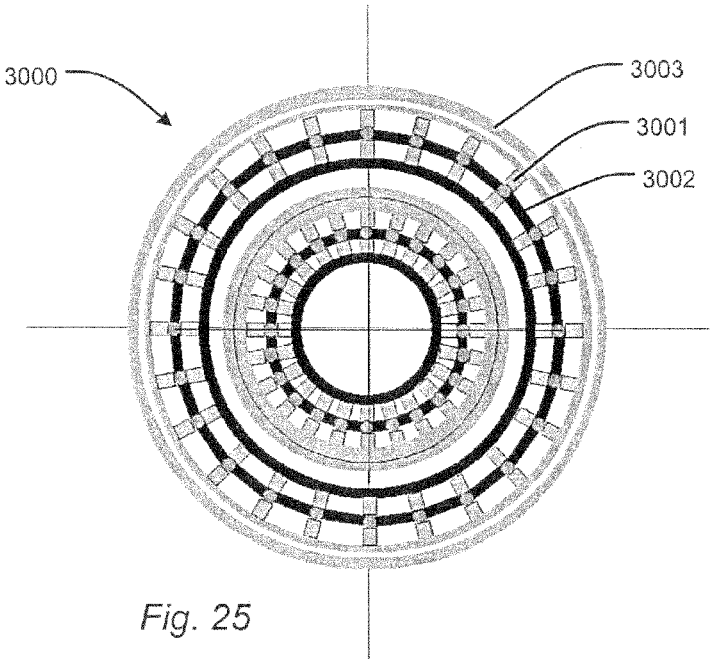

FIG. 25 schematically shows a collapsed net or cage placed inside a net or cage in expanded position, the outer circles represent the bag or bellows which is to be inflated and thereby sealing against the well bore wall in a final setting position.

Figure 26:
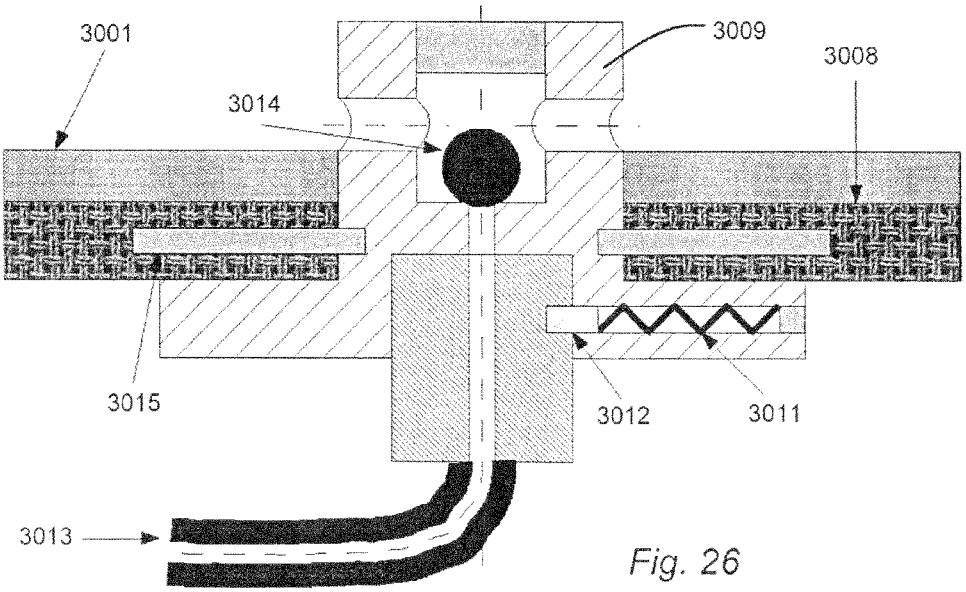

FIG. 26 schematically shows a valve to be used during inflation of the bag or bellows.

Figure 27:
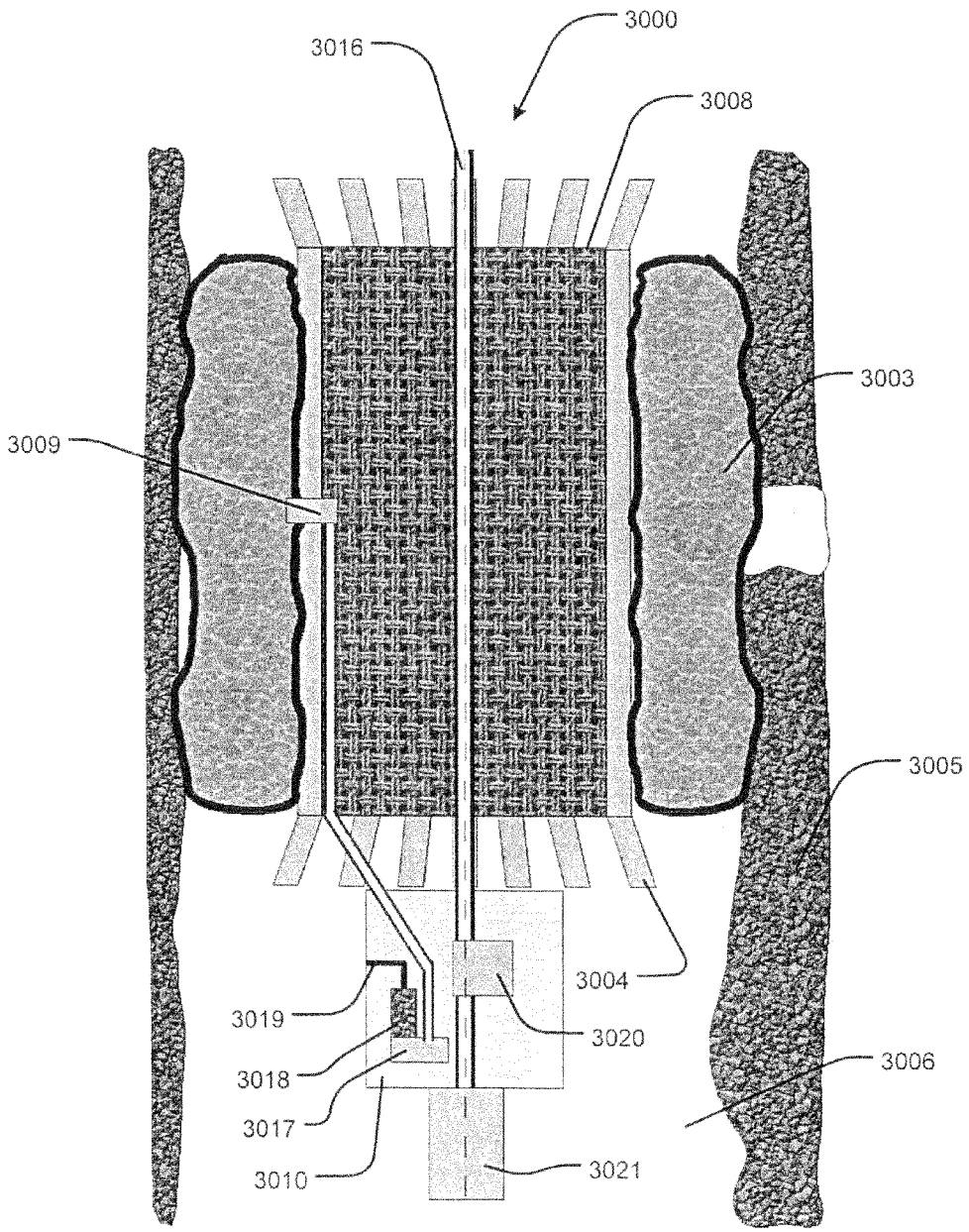

FIG. 27 schematically shows a patch apparatus, including a running tool, the patch apparatus being in the expanded position.

Figure 28:
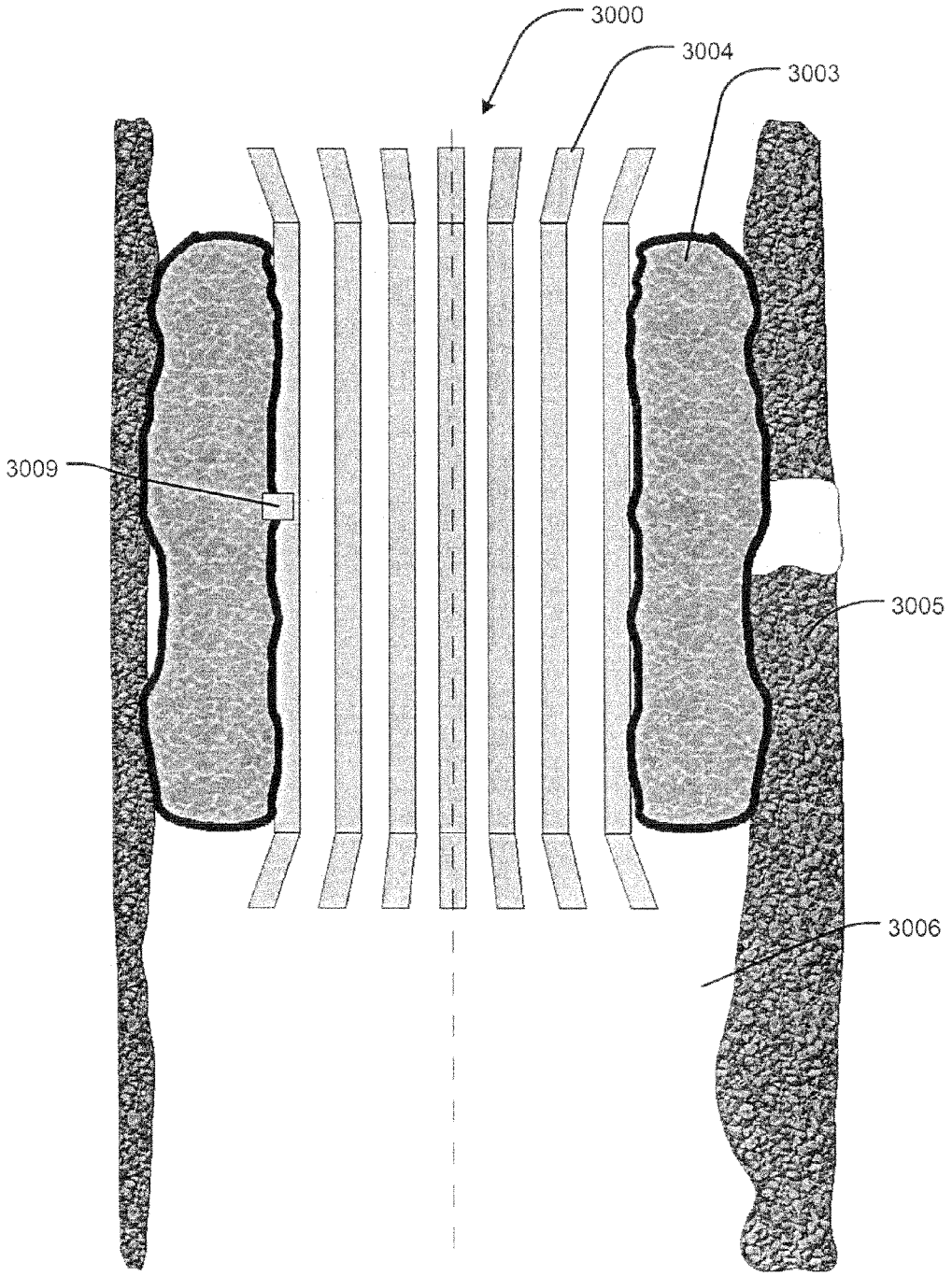

FIG. 28 schematically shows the patch apparatus when installed in a section drilled in an earth formation, the intermediate links are not shown.

Figure 29:
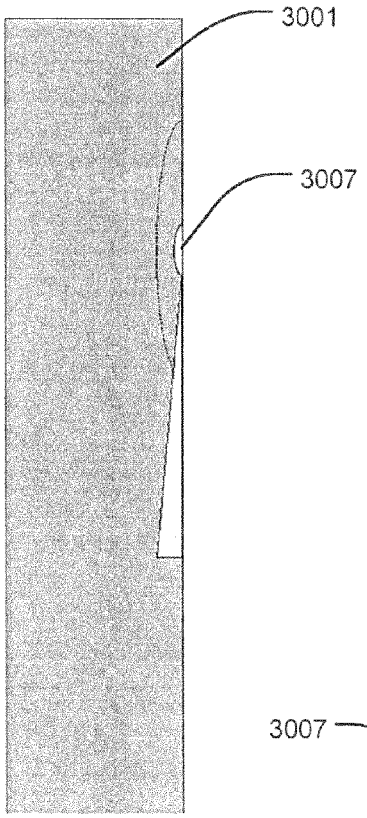

FIG. 29 schematically shows a side view of a sectional cut through the middle of an embodiment of an elongate member, where an intermediate link (not shown) is to be positioned and locked.

Figure 30:
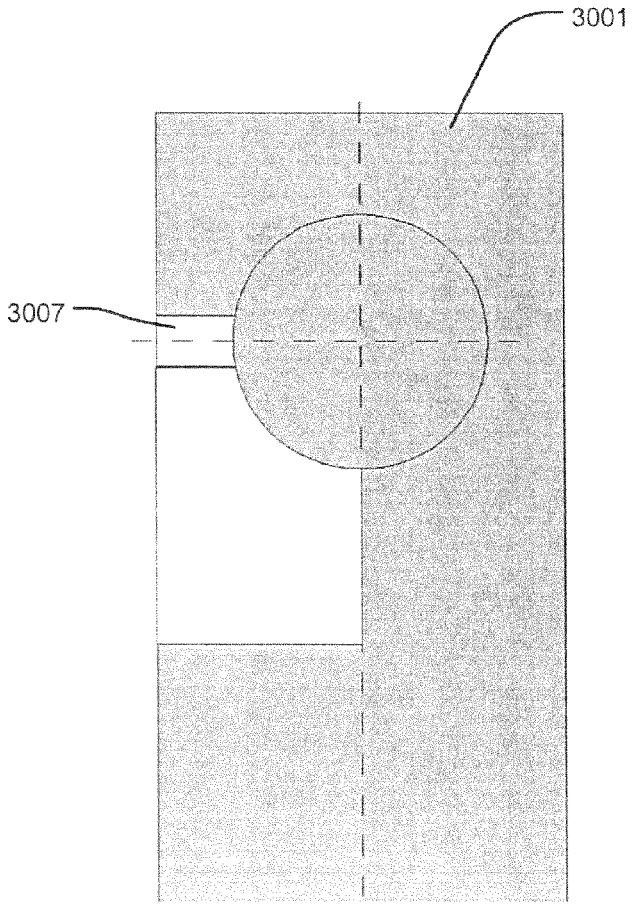

FIG. 30 schematically shows a front view of a sectional cut through the middle of an embodiment of an elongate member, where an intermediate link (not shown) is to be positioned and locked.

Figure 31:
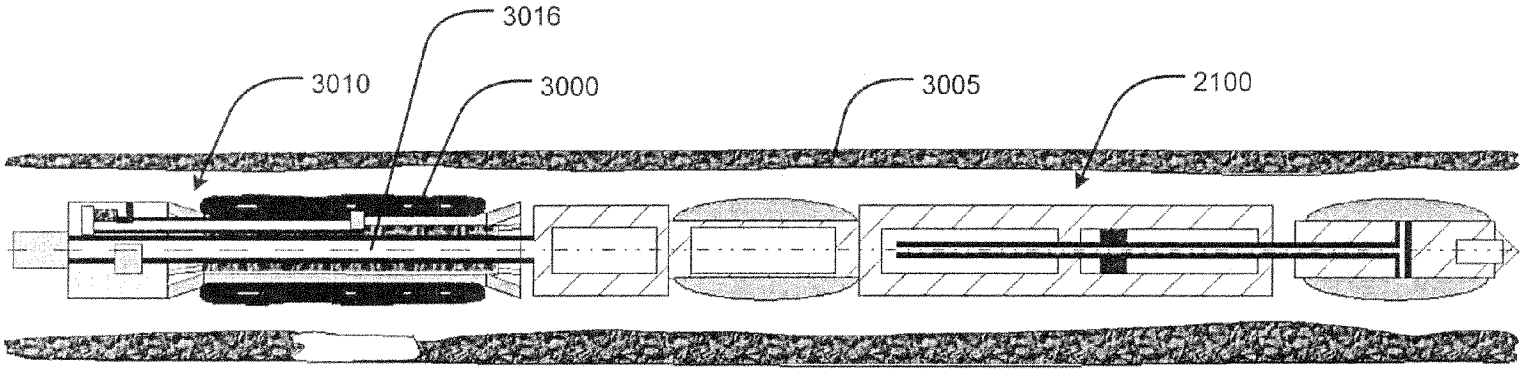

FIG. 31 schematically shows a running tool, a patch and a tractor being coupled together to form one assembly.

Figure 32:
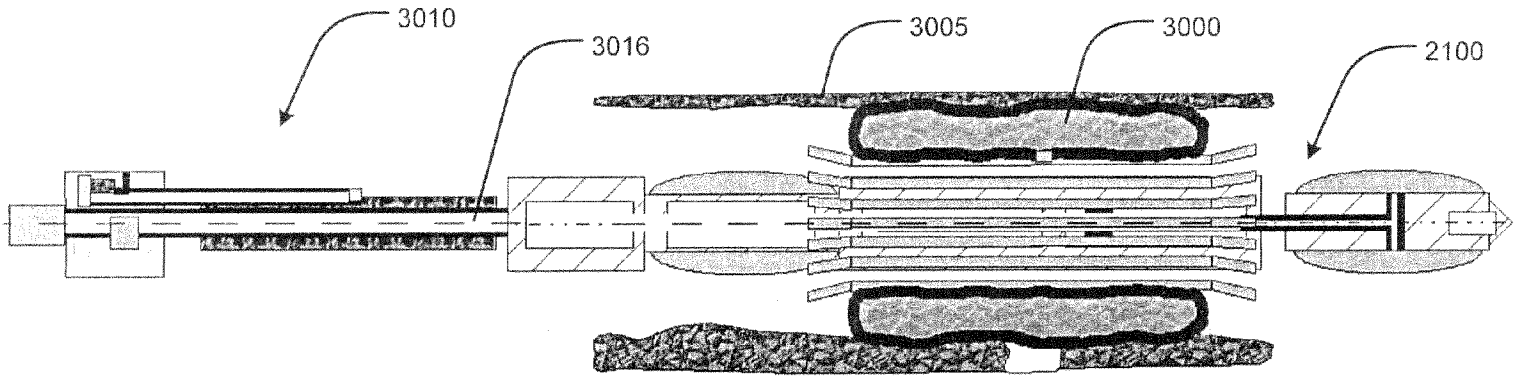

FIG. 32 schematically shows a running tool and a tractor being coupled together and advancing through a first patch already expanded and fixed in the wellbore.

DETAILED DESCRIPTION OF THE INVENTION

Device and system for examining a tubular channel

FIGS. 1 to 11 illustrate embodiments according to the invention of the employment of a data acquisition module for advancement through a wellbore in order to acquire data providing information revealing fractures in the wall of the wellbore, whereby at least one blocking system, on the basis of the data acquired, may be placed in the wellbore at the location of a fracture in the wall. Although the embodiments of the data acquisition module discussed in the following comprise several features, many of these features may not be necessary in order to carry out the method according to the invention or may not necessarily be comprised by the system according to the invention. According to the invention, the data acquisition module is adapted to be advanced by interaction with a fluid present in the wellbore which means that it is adapted to be conveyed by means of fluid flowing in the wellbore or that it is adapted to propel itself by interaction with fluid present in the wellbore. Furthermore, according to the invention, the data acquisition module acquires data providing information on its own position in relation to the wall of the wellbore and is controlled on the basis of said data in order to maintain a distance to the wall of the wellbore during its advancement. This means that the data acquisition module is adapted to steer itself radially in relation to the wellbore on the basis of its actual position in the wellbore; however, this may be with or without interaction from other apparatus, such as a remote control unit, for instance.

The person skilled in the art will understand that the following embodiments of a data acquisition module present examples of the data acquisition module according to the invention, but that several other embodiments are possible within the scope of the invention.

Figure 1:
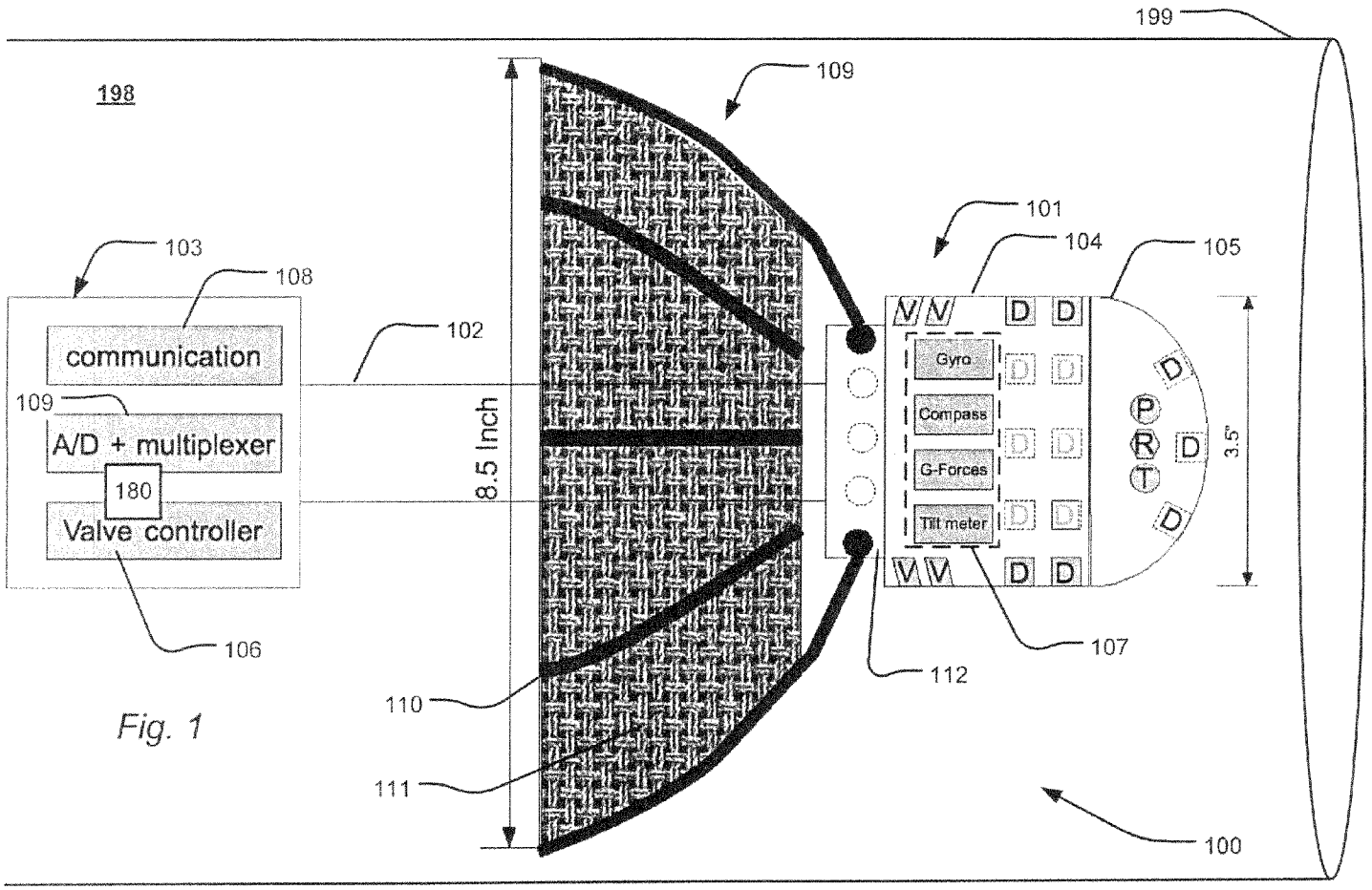
FIG. 1A shows a device pumped down into the tubular channel.
FIG. 1B shows a device connected to an external communication unit.

FIG. 1 illustrate a sectional view of an embodiment of a data acquisition module in the form of a device 100 for examining a tubular channel 199; the device 100 comprising a first 101, a second 102 and a third 103 part. In the above and below, a tubular channel may be exemplified by a borehole, a pipe, a fluid-filled conduit, and an oil-pipe.

The tubular channel 199 may contain a fluid. In the above and below, the fluid in the tubular channel may be exemplified by water, hydrocarbons, e.g. petroleum oil or gaseous hydrocarbons such as paraffins, naphthenes, aromatics, asphaltics and/or methane or gases with longer hydrocarbon chains such as butane or propane or any mixture thereof.

Figure 1B:
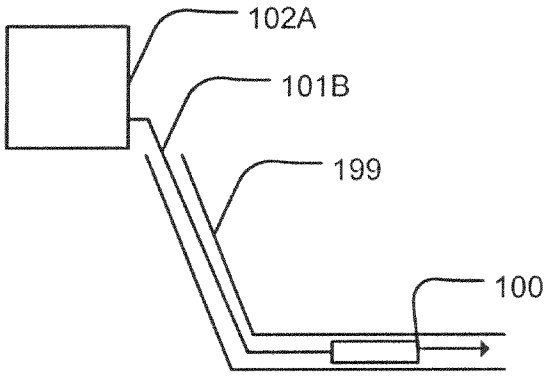
Figure 1A:
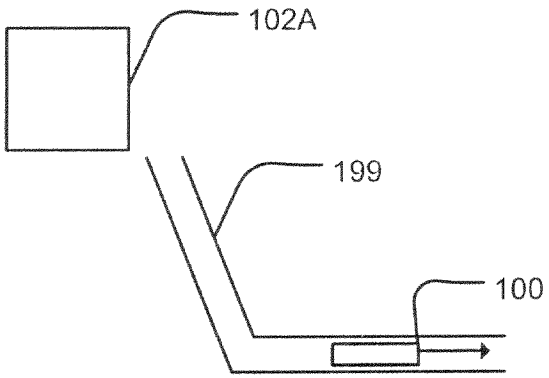

In an embodiment as illustrated in FIG. 1A, the device 100 may for example be pumped down into the tubular channel 199 without any physical connection/link to the surface/entrance of the tubular channel 199. In such an embodiment, the device 100 may be powered by batteries or obtain its power from the earth formation and/or the fluids in the well. Also hydrogen cells or combustion processes can be used to power the device. In the case of batteries, the batteries may be powered/charged by temperature differences of the surrounding via thermocouples and/or by a spinner driven by the fluid motion around the device 100 driving a dynamo being electrically coupled to the batteries. A control module outside the wellbore in the form of an external communication unit 102A, such as a computer communicatively coupled to an acoustic modem, situated in proximity to the entrance of the tubular channel 199 may communicate with the device 100 e.g. via the acoustic modem. In this way, data providing information revealing the position along the wellbore 199 of a fracture in the wall of the wellbore may be communicated wirelessly to a control module in the form of the communication unit 102A outside the wellbore, and at least one blocking system 1002, 3000 exemplified in the following may be placed in the wellbore at the location of the fracture in the wall on the basis of the data received by said control module.

In an alternative embodiment as illustrated in FIG. 1B, the device 100 may be connected via e.g. a wire 101B to an external communication unit 102A, such as a computer, situated in proximity to the entrance of the tubular channel 199. The external communication unit 102A may provide power to the device 100 via the wire which power could propel the device 100 down into tubular channel 199. Additionally or alternatively, the external communication unit 102A may communicate with the device 100 via the wire 101B.

The device 100 may comprise a first part 101, a second part 102 and a third part 103.

The three parts 101, 102 and 103 may e.g. be cast or moulded in plastic or aluminium or any other material or combinations thereof suitable of sustaining high pressure, which in high pressure wells can go up to 2000 bar, and temperatures ranging from e.g. 40 degrees C. at shallow depth to 200 degrees C. and beyond in the case of a high temperature well.

The first part 101 may, for example, contain a cylindrical part 104 and a semi-spherical cap part 105. The first part 101 may further contain a number of sensors.

For example, the first part may contain a number of ultrasonic sensors V, e.g. 4 ultrasonic sensors, for determining the relative fluid velocity around the first part 101. An ultrasonic sensor may be represented by a transducer. The ultrasonic sensors V may be contained within the first part 101, e.g. within the cylindrical part 104. The ultrasonic sensors V may provide data representing a fluid velocity.

Additionally, the first part 101 may, for example, include a number of ultrasonic distance sensors D, e.g. 13 ultrasonic distance sensors. The number of ultrasonic distance sensors may provide data representing a distance to e.g. the surrounding tubular channel 199. The ultrasonic distance sensors may be contained within the first part 101. For example, 10 ultrasonic distance sensors may be contained in the cylindrical part 104 of the first part 101, e.g. in a circumference of the cylindrical part 104 and thereby providing data representing a distance between the cylindrical part 104 and the surrounding tubular channel 199, and 3 ultrasonic distance sensors may be contained in the semi-spherical cap part 105, e.g. in the front of the semi-spherical cap part 105 providing data representing a distance between the semi-spherical cap-part and e.g. potential obstacles such as cave-ins/wash-outs in front of the device 100.

The ultrasonic sensors and ultrasonic distance sensors of the first part may be probing the fluid surrounding the device 100 and the tubular channel 199 through e.g. glass windows such that the sensors are protected against the fluid flowing in the tubular channel 199.

The first part may additionally comprise a pressure sensor P. The pressure sensor P may be contained in the semi-spherical cap part 105. The pressure sensor P may provide data representing a pressure of a fluid surrounding the device 100.

Further, the first part may contain an ohmmeter R for measuring the resistivity of the fluid surrounding the device 100. The ohmmeter may be contained in the semi-spherical cap part 105. The ohmmeter may provide data representing resistivity of the fluid surrounding the device 100.

Further, the first part may contain a temperature sensor T for measuring the temperature of the fluid surrounding the device 100. The temperature sensor T may be contained in the semi-spherical cap part 105. The temperature sensor T may provide data representing a temperature of the fluid surrounding the device 100.

The first part may additionally comprise a position-determining unit 107 providing data representing the position of the first part 101, and thus enabling position tagging of the data from the abovementioned sensors. The position tagging may, for example, be performed with respect to e.g. the entrance of the tubular channel 199.

In an embodiment, the position-determining unit 107 may comprise gyroscopes Gyro and a compass Compass and accelerometers G-forces and a tiltmeter (inclinometer) Tilt meter.

The device 100 may further comprise a programmable logic controller (PLC) 180 e.g. contained in the first 101 or in the third part 103. One or more of the above sensors, i.e. the ultrasonic sensors V, the ultrasonic distance sensors D, the pressure sensor P, the ohmmeter R, the temperature sensor T, and the position-determining unit 107, may be connected to the PLC e.g. via a wire and an analogue-to-digital (ND) converter and a multiplexer 109. For example, the PLC may be connected via respective wires and the analogue-to-digital (A/D) converter and a multiplexer 109 to the ultrasonic sensors V, the ultrasonic distance sensors D, and the position-determining unit 107. Via a number of data input from the sensors, the PLC is able to determine the surroundings and position of the device 100 and to calculate a control signal representing how the device 100 is to be steered. Thus, the PLC 180 may determine how to navigate through the tubular channel 199 via one or more of the steering mechanisms disclosed below i.e. in FIGS. 2, 3, 4 and 5 and associated text. For example, the PLC 180 may be communicatively coupled, e.g. via electric wires, to each of the steering mechanisms, and the PLC 180 may control the steering mechanisms via the control signal. In this way, the data acquisition module may acquire data providing information on its own position in relation to the wall 3005 of the wellbore 3006 and may be controlled on the basis of said data in order to maintain a distance to the wall of the wellbore during its advancement in the wellbore.

Via data input from one or more of the sensors described above, the PLC or a control module 102A outside the wellbore may be able to provide information revealing fractures in the wall of the wellbore; especially the position along the wellbore of such fractures.

Figures 2, 3:
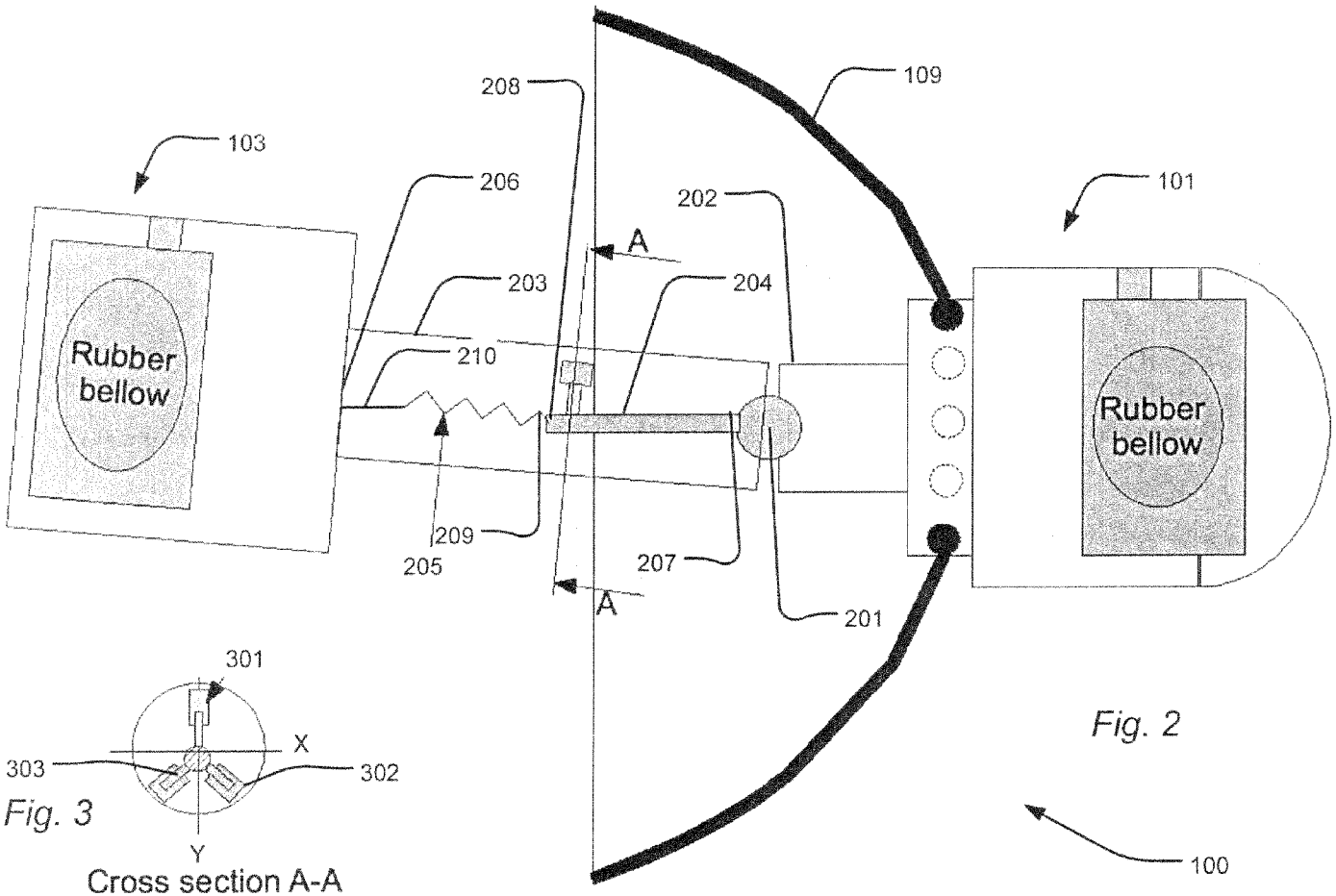
FIG. 2 shows the fishing neck of the device.
FIG. 3 shows a cross-sectional view of the fishing neck of the device.

The second part 102 may comprise a two-piece bar ("fishing neck") 202 and 203 connected via a ball joint 201 as seen in FIG. 2. The two-piece bar 202, 203 may have a cylindrical cross-section and may be hollow. Further, the two-piece bar 202, 203 may connect the first part 101 to the third part 103 via the ball joint 201. As illustrated in the figure, a first part 202 of the two-piece bar 202, 203 may be connected to the first part 101 of the device 100 and a second part 203 of the two-piece bar 202, 203 may be connected to the third part 103 of the device 100.

One of the two-piece bar parts, e.g. the second part 203, may contain a bar 204 physically connected at one end 207 to the ball joint 201 e.g. via glue, weld joint or the like. The other end 208 of the bar may be connected to a first end 209 of a spring 205. The other end 210 of the spring 205 may be physically connected to a side 206 of the second part 102 of the device 100 e.g. the side also connected to the second part 203 of the two-piece bar. The force exerted by the spring on the side 206 and the other end 208 of the bar 204 is of such a magnitude as to keep the device 100 i.e. the first part 202 and the second part 203 of the two-piece bar, in a straight line (e.g. 180 degrees+/−1 degree between the first part and the second part of the two-piece bar) via the ball-joint 201 when none of the cylinders disclosed below are activated.

A cross-sectional view along the Line A-A in FIG. 2 is shown in FIG. 3. FIG. 3 illustrates three cylinders 301. The cylinders 301 may e.g. be hydraulic or mechanical or a combination of hydraulic and mechanical cylinders (for example, a first cylinder may be mechanical and a second and a third cylinder may be hydraulic).

Each cylinder may comprise a cylinder barrel 302 and a piston 303. The cylinder barrels 302 may be connected to the inner wall of the second part 203 of the two-piece bar. The connection may be performed e.g. by a weld joint or a screw or glue or the like. The pistons 303 may be connected to the other end of the bar 208 e.g. by weld joints, glue, screws or the like.

The barrels 302 of the cylinders 301 may e.g. be placed at a 120 degree separation along the circumference of the inner wall of the second part 203 of the two-piece bar.

In order to steer the device 100, one or more of the cylinders may be activated in order to displace the bar 204 from the equilibrium position determined by the spring 205. The cylinders 301 may be able to displace the bar 204 in any position. In FIG. 3, for example, the top cylinder 301 has been activated and displaced the bar 204 from its spring determined equilibrium position determined by the intersection of the two lines X and Y. Thereby, the straight line between the first part 202 and the second part 203 of the two-piece bar is changed e.g. to 135 degrees+/−1 degree whereby the device 100 longitudinal axis is bend around the ball joint 201.

If the three cylinders are hydraulic, then the spring 205 may be replaced by springs in the cylinders such that when the cylinders are un-activated, the spring forces of the springs in the cylinders are of such a magnitude as to keep the device 100 i.e. the first part 202 and the second part 203 of the two-piece bar, in a straight line. The springs are located in the cylinders pushing on the pistons e.g. between the pistons 303 and the bar 204.

In an embodiment, the springs between the pistons 303 and the bar 204 may be push springs.

The bar 204 and the ball joint 201 may be hollow such as to, for example, allow passage of an electric wire from the first part 101 to the third part 103 via the two-piece bar and the ball-joint 201 and the bar 204. Additionally, the bar 204 and the ball joint 201 may allow passage of a tube e.g. a high pressure tube.

Thus, the device 100 may be steered by controlling the cylinders 301 and thereby the fishing-neck of the device 100.

In an embodiment, data from one or more of the sensors in the first part 101 may be transmitted to the third part 103 via an electric wire from the first part 101 to the third part 103 via the ball joint 201 and the bar 204.

Figure 4:
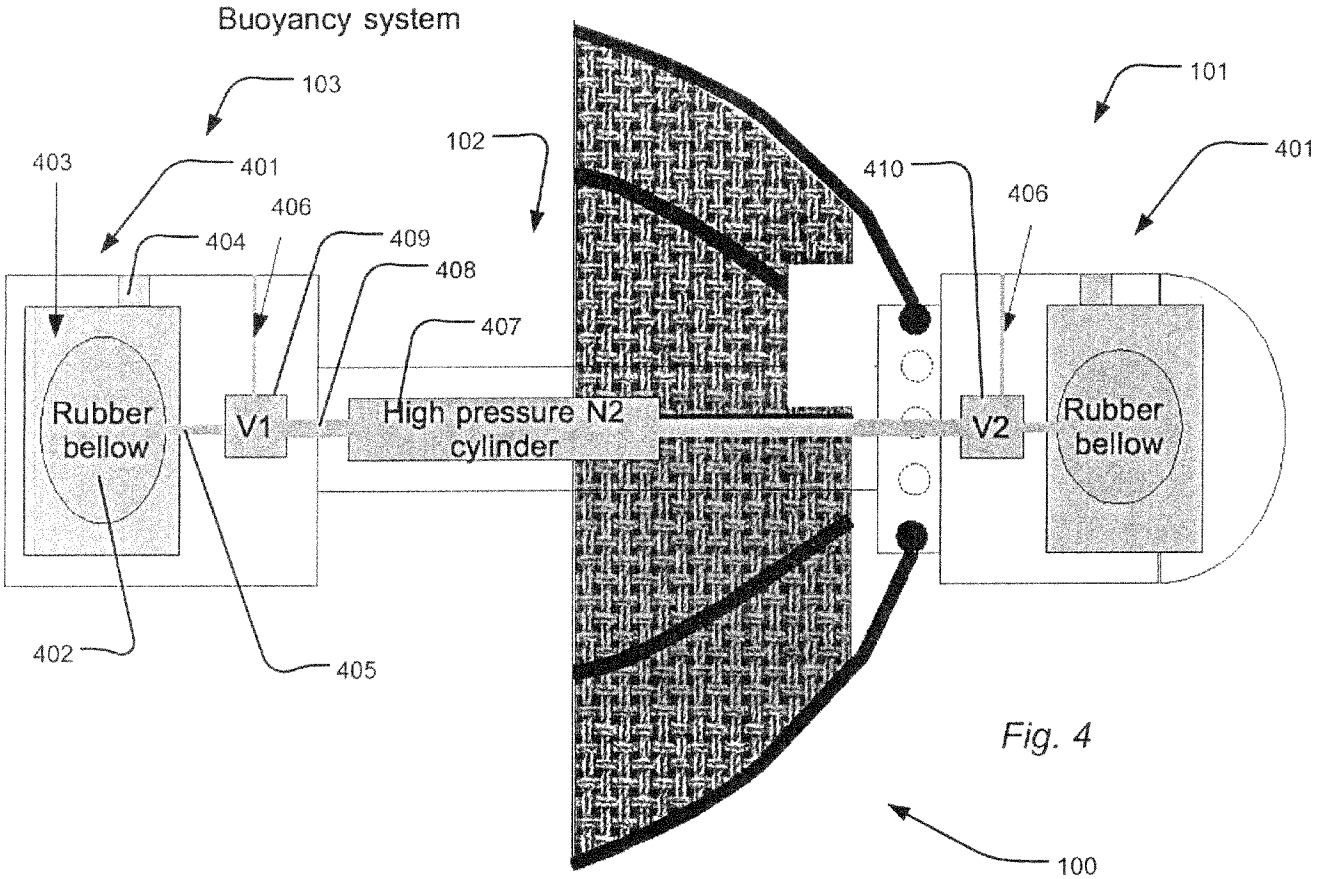
FIG. 4 shows an embodiment of a device 100 for examining a tubular channel comprising buoyancy means.

In an embodiment, the high pressure cylinder 407 of FIG. 4 may be in fluid communication with the three hydraulic cylinders of FIG. 2 e.g. via high pressure tubes and respective valves and chokes (to provide more accuracy to the fluid flow by limiting the volume per unit time). Thereby, the three hydraulic cylinders 301 may be powered by the high pressure cylinder 407. The amount of second fluid transferred from the high pressure cylinder 407 to the cylinders 301 may be controlled by the PLC 180 via the control signal by controlling the valves.

In the above and below, the second fluid contained in the high-pressure cylinder 407 may be chosen from the group of fluids which are known for their expansion when the pressure drops. The most effective fluids are therefore gaseous. For example Nitrogen or Helium or hydrocarbon gas or CO2 could be used as the second fluid with which the cylinder 407 is filled.

In an alternative embodiment, the three cylinders may be mechanical cylinders being controlled and driven by motors which in turn are powered by e.g. batteries or any other alternative energy source.

Alternatively, in the embodiment where the device is connected via a wire to an external communication unit 102A positioned in proximity of the entrance providing power to the device 100 via the wire, the three cylinders may be powered via the wire.

The third part 103 of the device 100 may comprise communication means 108 such as an acoustic modem enabling communication between the device 100 and the surface, e.g. the external communication unit 102A positioned in the proximity to the tubular channel 199 entrance. For example, the device 100 may transmit data from one or more of the sensors to the external communication unit 102A via the communication means 108.

In an embodiment, repeaters may be utilized in connection with the acoustic modem. A repeater may pick up a signal from the acoustic modem of the device 100 (or from another repeater) and amplify the received signal to its original strength. Thereby, the distance over which the device may communicate with the external communication unit 102A may be increased. The re-pesters may, for example, be pumped down the tubular channel 199 e.g. when/if the signal received from the communication 108 means of the device 100 drops below a threshold value e.g. 10 dBm.

Alternatively or additionally, the communication means 108 may comprise a number of radio-frequency identification (RFID) tags e.g. 100 RFID tags. The RFID tags may be released from the device 100 at a regular time interval e.g. one RFID tag every 2 minutes, and before release, a RFID tag would be imprinted with the data recorded by the sensors at the position of its release. When the device 100 has travelled a required distance e.g. to the end of the tubular channel 199, the RFID tags may be brought up and recovered at the entrance of the tubular channel 199, e.g. at the surface of the well, during fluid production. At the surface of the well, the RFID tags may be read out. Other microchips which can contain data like the memory components in a USB stick can also be used. The requirement for obtaining the data is that the well has to be produced such that the RFID or other memory devices, such as memory chips, will be brought to surface.

In this way, data providing information revealing the position along the wellbore 199 of a fracture in the wall of the wellbore may be communicated outside the wellbore by means of a radio-frequency identification (RFID) tag released by the data acquisition module 100, conveyed by the fluid present in the wellbore and collected outside the wellbore.

In an embodiment, the RFID tags may be comprised in the device 100 e.g. in the third part 103 and the RFID tags may be released from the device 100 e.g. via a tube in the rear end of the third part 103 i.e. the end facing away from the second part 102. Via a controlled detonation performed by detonation means in fluid communication with the tube, a RFID tag may be released at certain intervals controlled by the PLC 180. For example, the PLC 180 may control the detonation means In an embodiment, the communication means 108 may further be adapted to receive acoustic signals from the entrance of the tubular channel thereby enabling a two-way communication between the external communication means 102A comprising an acoustic modem and being positioned in proximity to the tubular channel 199 entrance and the device 100. Thereby, the device 100 may for example receive control data from the external communication unit 102A via the communication means 108.

The third part may additionally comprise a valve controller 106 for controlling a number of valves as disclosed below.

Further, the third part 103 may comprise a analogue-to-digital (ND) converter and a multiplexer 109. The ND converter and multiplexer may receive analogue data, e.g. from one or more sensors in the first part 101, via an electric wire and process the analogue data into digital data which, for example, may be transmitted to the surface of the well via the communication means 108 and/or via a wire 101B and/or the data may be processed by the PLC 180.

The device 100 may further comprise a flexible member 109. For example, the flexible member may comprise arms 110 made of titanium and a texture 111 made of aramid. The flexible member 109 may have a semi-spherical shape as indicated in FIG. 1 and the device 100 may, for example, be able to adjust the maximal outer diameter of the semi-spherical shape between for example 3.5 inch (88.9 mm) and 8.5 inch (215.9 mm). The outer diameter is limited by the fact that the flexible member cannot expand further than the mentioned 8.5 inch because the flexible member has reached its maximum outer diameter. In a tubular channel with an inner diameter of below 8.5 inch, the outer diameter of the flexible member may be determined by the inner diameter of the tubular channel.

Thereby, the device is able to run through tubing and thus, the top completion of a well does not have to be removed (pulled of) in order to run the device into the well.

In fact, thereby, the data acquisition module 100 may advance through a first part of the wellbore 199, 2199, 3006 in order to reach a second part of the wellbore, at least one blocking system 1002, 3000 may be placed in the second part of the wellbore, and the first part of the wellbore may have a diameter that is smaller than, and preferably less than the half of, the diameter of the second part of the wellbore.

The flexible member 109 may e.g. be attached to the first part 101. For example, the first part 101 may comprise a cylindrical attachment part 112 to which the flexible member 109 may be attached e.g. via weld joints or a ball bearing. The projection of the flexible member on the second part 102 may be varied and it may depend on the outer diameter of the semi-spherical shape. If for example the flexible member 109 is fully expanded (maximal outer diameter) then the projection of the flexible member 109 onto the second part 102 (i.e. the longitudinal axis of the device 100) is minimal. If for example the flexible member 109 is fully collapsed (minimal outer diameter) then the projection of the flexible member 109 onto the second part 102 is maximal. Alternatively or additionally, the projection of the flexible member 109 onto the second part 102 may be varied by altering the angle of the flexible member. Changing the angle of the flexible member will cause an unbalanced push force on the flexible member versus the axis of the device this will move the device away from the axis.

The flexible member 109 may, for example, be utilized in propelling the device 100 down the tubular channel 199. By applying a pressure on the entrance 198 side of the tubular channel 199 may expand the flexible member 109 to its maximal size, whereby the device 100 may be propelled down the tubular channel 199. If, for example, the device 100 encounters a cave-in (or a wash-out) in its path, the device 100 may change the maximal outer diameter of the flexible member such as to enable passage of the device 100 past the cave-in by adapting the outer diameter of the device 100 to the diameter of the cave-in.

FIG. 4 shows an embodiment of a device 100 for examining a tubular channel comprising buoyancy means 401. The device 100 of FIG. 4 may comprise the technical features described under FIGS. 1 and/or 2 and/or 3.

The buoyancy means 401 may provide a controlled vertical movement of the data acquisition module in the form of the device 100 relative to the wellbore.

Further, the device of FIG. 4 may comprise buoyancy means 401 (e.g. float tanks or hydrophores) in the first part 101 and in the third part 103. Each of the buoyancy means 401 may comprise a rubber bellows 402 contained in a titanium cylinder 403. In stead of a rubber bellows 402, of course, other suitable arrangements may be employed, such as a balloon-type device, a metal bellows or a cylinder with displaceable piston. The titanium cylinders 403 prevent the rubber bellows 402 from bursting. The titanium cylinders 403 further comprise an in-/outlet 404 enabling fluid from the tubular channel 199 to enter or exit. The in-/outlet 404 of the titanium cylinders may be covered with a permeable metal membrane.

The first part 101 and the third part 103 may each further comprise a valve arrangement 409, 410, for instance in the form of a three-way valve V1, V2. The three-way valve V1, V2 may be fluidly coupled to the respective rubber bellows 402 e.g. via respective tubes 405. Further, the three-way valves V1, V2 may be fluidly coupled to the fluid in the tubular channel via respective vent lines 406. Additionally, each of the three-way valves V1, V2 may be fluidly coupled to a high pressure cylinder 407, e.g. situated in the second part 102 of the device 100, via respective tubes 408. The high pressure cylinder 407 may contain a second fluid. Naturally, the distribution and arrangement of the different valves of the valve arrangement, the high pressure cylinder 407, the vent lines 406 and the tubing connecting these parts may be different than mentioned and shown in the figures.

The valve arrangements 409, 410, for instance in the form of three-way valves V1, V2, may be controlled by the valve controller 106, illustrated in FIG. 1, which may be communicatively coupled to the three-way valves V1, V2 e.g. via an electric wire. The valve controller 106 may, for example, receive control signals from the PLC ordering the valve controller 106 to increase and/or decrease buoyancy of the buoyancy means 401 according to the calculation results obtained by the PLC. The PLC may be communicatively coupled to the valve controller 106 e.g. via an electric wire.

Using the high pressure cylinder 407, the valve arrangements 409, 410 and the buoyancy means 401, the device 100 is able to control its buoyancy.

For example, in the event that the rubber bellows 402 are filled with the sec- and fluid e.g. N2 and the buoyancy is to be decreased i.e. the device 100 has to dive, then the three-way valve V1, V2 is opened between the rubber bellows 402 and the N2 vent line 406, whereby fluid from the tubular channel 199 may enter the titanium cylinder 403 via the permeable metal membrane 404 and simultaneously, the second fluid may flow out of the rubber bellows 402 through the N2 vent line 406 due to the elastic pressure exerted by the rubber bellows 402 on the second fluid. When the buoyancy of the device has been decreased sufficiently, e.g. determined by one or more of the sensors and the PLC 108, the three-way valve 406 is set in a closed position by receiving a control signal from the PLC 180.

Subsequently, if the buoyancy of the device 100 is to be increased i.e. the device 100 has to be raised, then the three-way valve V1, V2 is opened between the rubber bellows 402 and the high pressure cylinder 407, whereby the second fluid of the high pressure cylinder 407, e.g. N2, is pressed into the rubber bellows 402. Thereby, the rubber bellows 402 expands and thus displaces the fluid, e.g. fluid from the tubular channel, present in the titanium cylinder 403 via the permeable metal membrane 404. When the buoyancy of the device has been increased sufficiently, e.g. determined by one or more of the sensors and the PLC 108, the three-way valve 406 is set in a closed position by receiving a control signal from the PLC 180.

The valve arrangements 409, 410 may, alternatively to the three-way valves V1, V2 described above, be composed by simple on/off valves, for instance in the form of solenoid valves. Any other valve suitable for opening and closing a tube connection may also be employed. For instance, each of the three-way valves V1, V2 may be replaced by a first and a second on/off valve, the first on/off valve connecting the high pressure cylinder 407 and the rubber bellows 402, and the second on/off valve connecting the rubber bellows 402 and the vent line 406. For instance, the second on/off valve may be separately connected by means of its own tubing with the rubber bellows 402, whereby the first on/off valve may similarly be connected by means of its own tubing with the rubber bellows 402 (this embodiment is, however, not shown in the figures). Alternatively, the second on/off valve may be connected, for instance by means of a T-type connection, with a tubing connecting the first on/off valve and the rubber bellows 402. Any other arrangement of valves suitable for filling and emptying the rubber bellows 402 with fluid may be employed.

In the case of simple on/off valves or functionally equivalent type of valve, the first on/off valve may be opened in order to let the second fluid e.g. N2 flow into the rubber bellows 402, and the second on/off valve may be opened in order to let the second fluid escape from the rubber bellows 402. When the rubber bellows 402 is filled with the second fluid in order to increase buoyancy, of course, the second on/off valve should normally be substantially closed in order to impede escape of the second fluid from the rubber bellows 402.

In an embodiment, a spinner/impeller may be attached to the permeable metal membrane 404 or placed inside the permeable metal membrane such that the spinner is spun when the fluid from the tubular channel 199 flows in or out via the permeable metal membrane 404. Thereby, the spinner is able to act as a dynamo and if the device 100 is powered by batteries, the spinner may be electrically coupled, e.g. via an electric wire, to the batteries of the device 100, and thereby the batteries may be recharged by the spinner.

In an embodiment, the valve arrangements 409, 410, for instance in the form of the three-way valves V1, V2, may be equipped with a flow restriction in order to limit the flow volume per unit time to thereby allow a certain accuracy of the three-way valves.

Thus, the device 100 may be steered by controlling its buoyancy using the high pressure cylinder 407, a valve arrangement 409, 410, and the buoyancy means 401. The buoyancy of the device 100 may be controlled by the PLC 180 receiving data from the sensors and transmitting a control signal to the valve arrangements 409, 410. Alternatively, the buoyancy of the device 100 may be controlled by the external communication unit 102A receiving data from the sensors and transmitting a control signal to the valve arrangements 409, 410.

In an embodiment, the buoyancy means 401 may be used to e.g. steer the first part 101 up or down with respect to the ball joint 201 e.g. by increasing the buoyancy of the buoyancy means 401 in the first part 101, e.g. by pumping the second fluid from the high pressure cylinder 407, e.g. N2, into the rubber bellows 402 of the first part 101 thereby displacing fluid from the titanium cylinder 403 to the tubular channel, and/or decreasing the buoyancy of the buoyancy means 401 in the third part 103, e.g. by displacing the second fluid from the rubber bellows 402 with fluid from the tubular channel 199 in the titanium cylinder 403 of the third part 103, as disclosed above.

Figure 5:
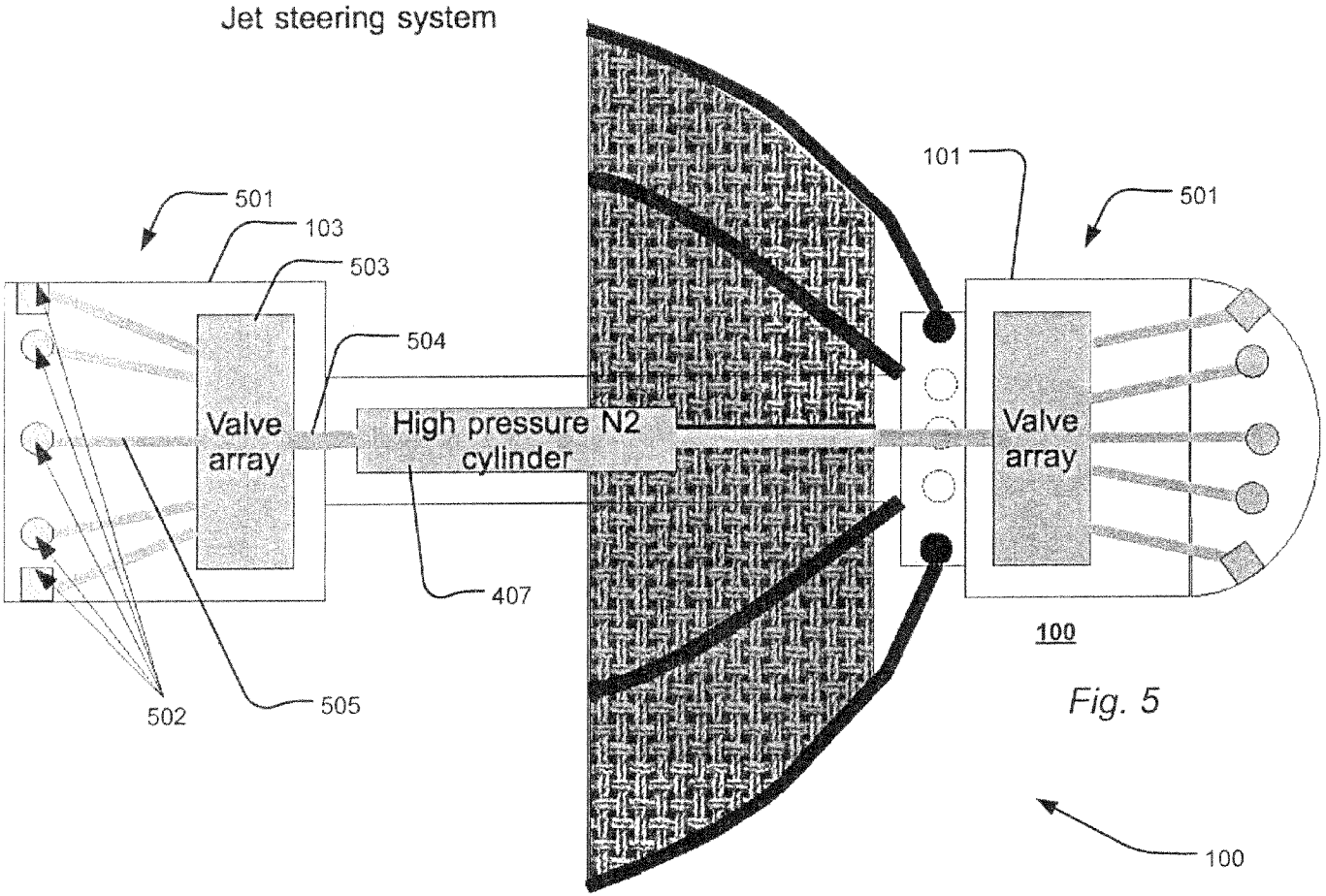
FIG. 5 shows an embodiment of a device 100 for examining a tubular channel comprising jet nozzle means.

FIG. 5 shows an embodiment of a device 100 for examining a tubular channel comprising jet nozzle means. The device 100 of FIG. 5 may or may not comprise some of or all of the technical features described under FIGS. 1 and/or 2 and/or 3 and/or 4.

Further, the device of FIG. 5 may comprise jet nozzle means 501 in the first part 101 and in the third part 103.

Each of the jet nozzle means 501 may comprise a number of nozzles 502, e.g. 5 nozzles, through which a jet of second fluid may be thrust. Additionally, the jet nozzle means 501 may comprise a valve array 503. The valve array 503 may be fluidly coupled to the high pressure cylinder 407 via e.g. respective high pressure tubes 504. Additionally, the valve array 503 may be fluidly coupled to each of the nozzles via respective high pressure tubes 505.

The nozzles 502 may be placed in the rear of the third part 103 and in the front of the first part 101 as seen in FIG. 5. Further, the nozzles may be in fluid communication with the fluid in the tubular channel 199 thereby enabling each nozzle to eject the second fluid, e.g. a high pressure fluid, from the high pressure cylinder 407 when enabled to do so via the valve array 502. The valve array 503 may be communicatively coupled to the PLC 180 e.g. via electric wires, such that the valve array 503 may be controlled by the PLC 180 e.g. based on sensor data treated by the PLC 180.

If, for example, the device 100 is to move straight forward, the valve array 501 may open a valve between the high pressure cylinder 407 and the centre nozzle 502 in the valve array 503 of the third part 103 thereby establishing a fluid coupling between the high pressure cylinder 407 and the centre nozzle 502. Thus, the second fluid may be trust from the high pressure cylinder 407 via the centre nozzle 502 straight backwards into the fluid of the tubular channel 199. Therefore, the device 100 will move in the opposite direction of the thrust second fluid due to conservation of momentum i.e. straight forwards.

If, for example, the device 100 is to move backwards and downwards, the valve array 501 may open a valve between the high pressure cylinder 407 and the top nozzle 502 in the first part 101 thereby establishing a fluid coupling between the high pressure cylinder 407 and the top nozzle 502. Thus, the second fluid may be trust from the high pressure cylinder 407 via the top nozzle 502 upwards and forwards into the fluid of the tubular channel 199. Therefore, the device 100 will move in the opposite direction of the thrust the second fluid due to conservation of momentum i.e. downwards and backwards.

Thus, the device 100 may be steered using the nozzles 502, the valve array 501 and the high pressure cylinder 407. The second fluid ejected from the nozzles of the device 100 may be controlled by the PLC 180 receiving data from the sensors and transmitting a control signal to the valve array 503 controlling the valve fluidly coupled to the nozzle(s) from which the second fluid is to be ejected. Alternatively, the second fluid ejected from the nozzles of the device 100 may be controlled by the external communication unit 102A receiving data from the sensors and transmitting a control signal to the valve array 503.

In an alternative embodiment, the jet nozzle means 501 described above and shown in FIG. 5 may be replaced or supplemented by means of a number of propellers or similar devices (not shown) adapted to provide a thrust that may propel and/or change the direction of the device 100 for examining a tubular channel. Said propellers or similar devices may be powered by electric motors or in any other suitable way. Especially, the jet nozzle means 501 described above or the mentioned alternative or supplemental propellers or similar devices may provide a controlled radial movement of the data acquisition module in the form of the device 100 relative to the wellbore.

Figure 6:
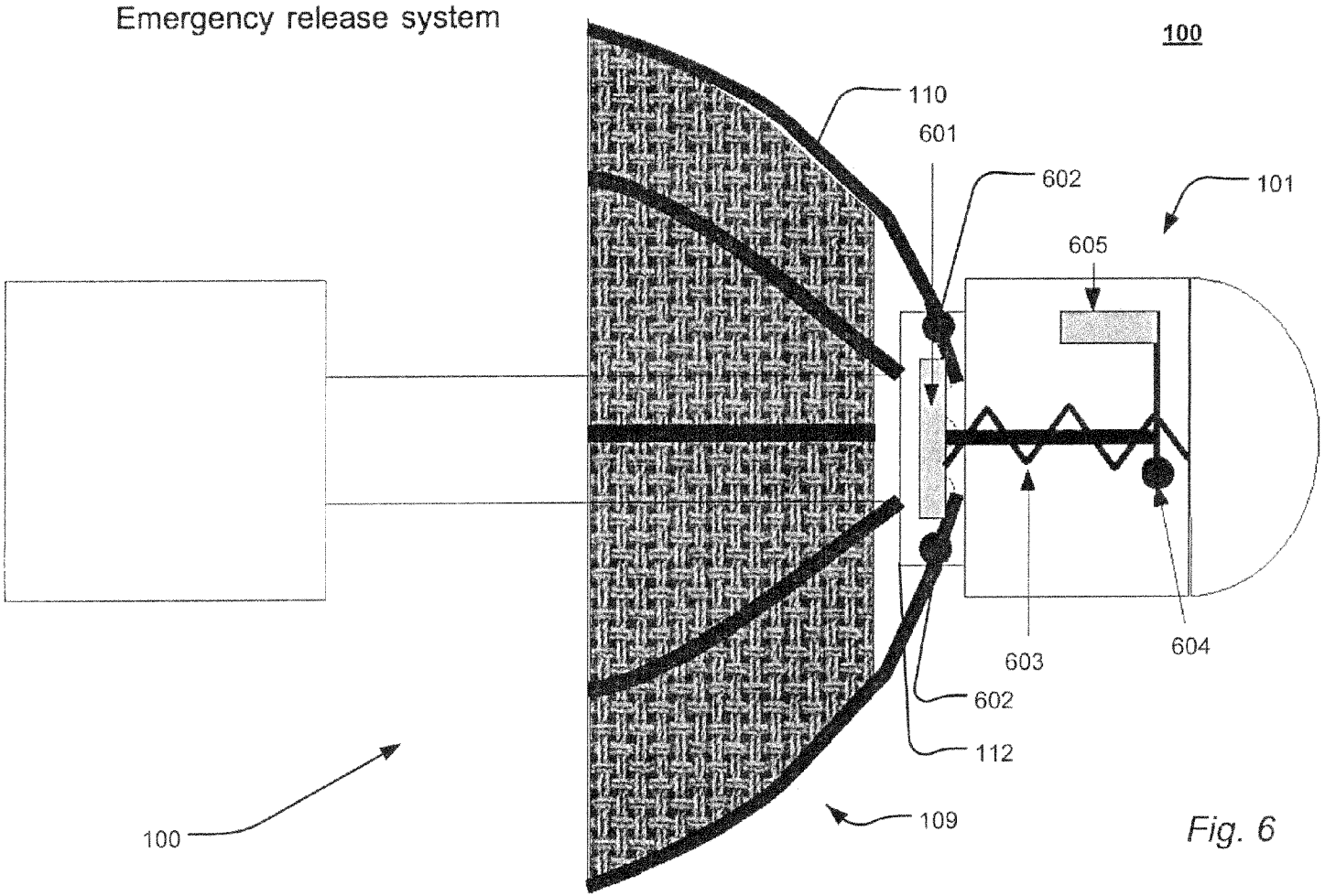
FIG. 6 shows an embodiment of a device 100 for examining a tubular channel comprising means for contracting the flexible member.

FIG. 6 shows an embodiment of a device 100 for examining a tubular channel comprising means for contracting the flexible member. The device 100 of FIG. 6 may comprise the technical features described under FIGS. 1 and/or 2 and/or 3 and/or 4 and/or 5.

Further, the device 100 of FIG. 6 may, in the first part 101, comprise a disc 601, e.g. positioned in the cylindrical attachment part 112, to which disc 601 the arms 110 of the flexible member 109 may be in physical contact. Further, the arms 110 may be attached to the cylindrical attachment part 112 via ball bearing 602 or the like enabling the flexible arms 110 to rotate around the ball bearing 602. Thereby, by translating the disc 601 to the right of FIG. 6, the arms 110 may be collapsed and by translating the disc 601 to the left of FIG. 6, the arms may expand e.g. due to fluid pressure in the tubular channel 199. Further, the first part 101 may comprise a spring 603, a second rotating bar 604 and an electro-magnet 605 further described under FIG. 7.

Figure 7:
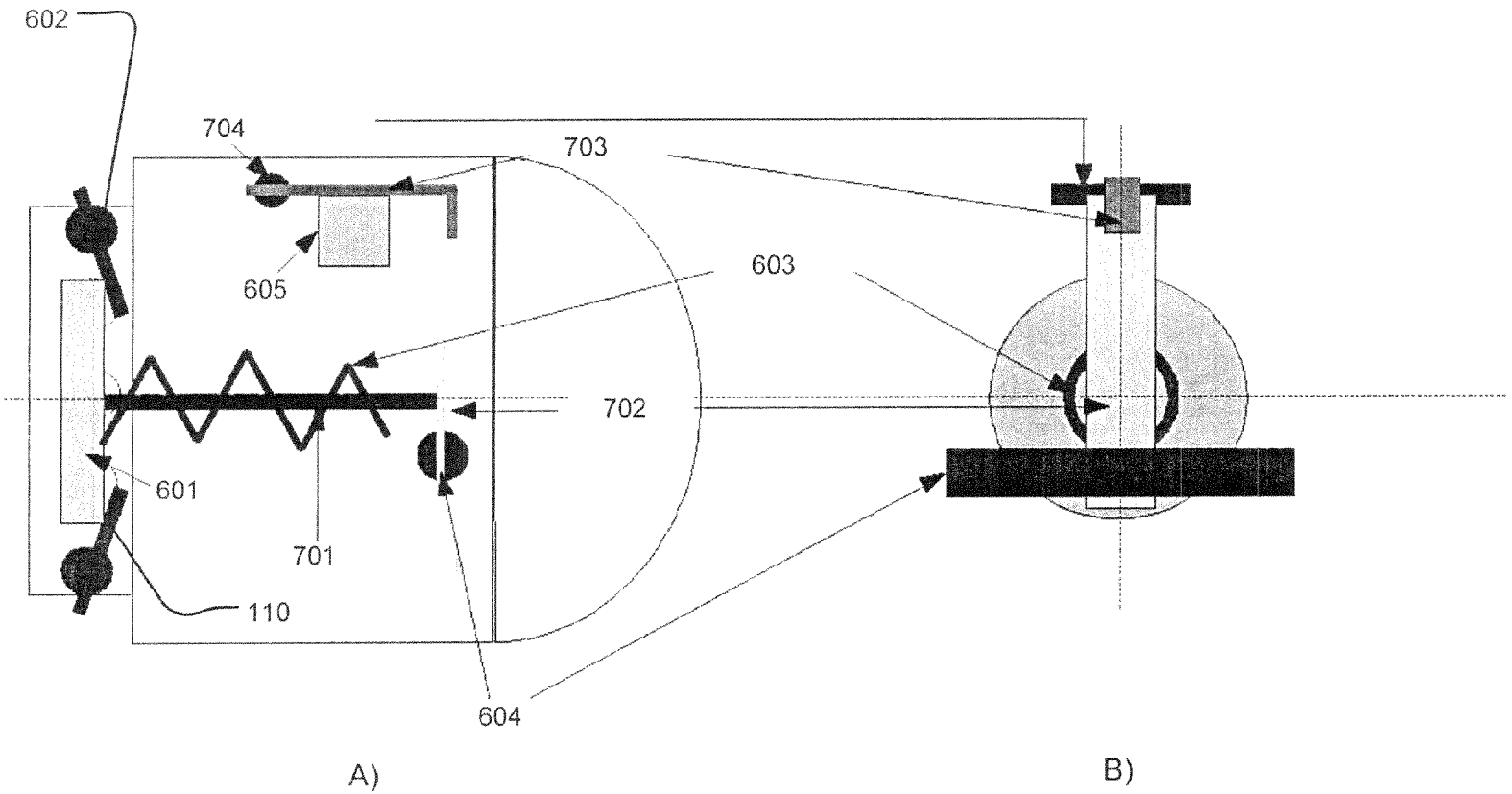
FIG. 7 shows an enlargement of the first part of an embodiment of the device.

FIG. 7 shows an enlargement of the first part 101 of the device 100 of FIG. 6. FIG. 7 A) is a side view of the first part 101 and FIG. 7 B) is a front view. The first part comprises the ball bearings 602, the arms 110, the disc 601, the electro-magnet 605, the spring 603 and the second rotating bar 604. Additionally, the first part comprises a pin 701 attached at one end to the disc 601. The pin is further connected to the spring 603 which may be a pull spring. The spring 603 pulls the pin 701 attached to the disc 601 to the right of FIG. 7. Thereby, the other end of pin 701 pushes on a plate 702. The plate 702 is held in place in one end by a second plate 703 and in the other end by the rotating bar 604. The second plate 703 is held in place by the electro-magnet 605 and one end to a first rotating bar 704 and the other end is holding the first end of the plate 702. Thus, when power to the electro-magnet 605 is terminated, the electro-magnet 605 releases the second plate 703 which rotates around the first rotating bar 704. Thereby, the first end of the plate 702 is released and the plate 702 rotates around the second rotating bar 604 allowing the pin 701 to move to the right of FIG. 7, whereby the disc 601 is moved to the right thus exerting a force on the arms 110. Thereby, the arms 110 and thus also the texture 111 are collapsed.

With the above design, the force required to hold the pin 701 in position is small, e.g. in the order of half a Newton.

By being able to decrease the outer diameter of the device 100 via the flexible member 109, the device 100 may adjust its outer diameter according to obstructions in the tubular channel 199. The device 100 may likewise adjust its outer diameter in order to advance through a blocking system, for instance in the form of a patch-type apparatus 3000, already placed in the tubular channel 199. Further, should the device 100 become stuck in a tubular channel 199, e.g. due to a wash-out or the like, the device is able to collapse the flexible member 109 via the means for contracting the flexible member disclosed with respect to FIG. 6 and FIG. 7. In an embodiment, the PLC 180 may be communicatively coupled to the electro-magnet 605. By transmitting a control signal to the electro-magnet 605, the PLC 180 may control the electro-magnet 605 e.g. in the event where the device 100 velocity is zero m/s for a given period e.g. one minute. When receiving the control signal, the electro-magnet may be turned off and thereby collapsing the flexible member as disclosed above.

In an embodiment, the electro-magnet 605 may be replaced by an acid soluble member and the pin 701 may be released by providing contact between the acid soluble member 605 and the plate 703. Thereby, the plate 703 may be etched through whereby the first end of the plate 702 is released and the plate 702 rotates around the second rotating bar 604 allowing the pin 701 to move to the right of FIG. 7, whereby the disc 601 is moved to the right thus exerting a force on the arms 110. Thereby, the arms 110 and thus also the texture 111 are collapsed.

In an embodiment, the device 100 may comprise a mechanical arm or similar device, such as, for instance, a balloon or bellows, which may be used to push the device 100 from a wall of the tubular channel 199 opposite the direction the device 100 wants to move in.

As an example, the device 100 may be heading towards a wall of the tubular channel 199. The ultrasonic distance sensors transmit data to the PLC which determines that in order to avoid the wall, the upper front nozzle should eject the second fluid. Subsequently, the PLC 180 transmits a control signal indicating how much and/or how long the valve in the valve array 503 controlling the upper front nozzle should open to the valve array 503. When the valve array 503 receives the control signal, the valve fluidly coupled to the upper front nozzle is opened and a jet of second fluid is ejected from the nozzle.

Further, as an example, the device 100 may be heading towards a leg of a fishbone well. The ultrasonic distance sensors transmit data to the PLC which determines that in order to avoid the leg of the fishbone well, the buoyancy of the device 100 should be increased. Subsequently, the PLC 180 transmits a control signal indicating how much and/or how long the valve arrangements 409, 410 controlling the fluid coupling between the rubber bellows 402 and the high pressure cylinder 407 should open. When the valve arrangements 409, 410 receive the control signal, the valves open according to the control signal and the second fluid from the high pressure cylinder 407 enters the rubber bellows 402 thereby increasing the buoyancy of the device 100.

In an embodiment, the device 100 may be pumped down by means of the flexible member 109, as disclosed above, a certain length of the tubular channel 199, e.g. the cased part of the tubular channel 199, and from thereof, i.e. in the open hole completion part of the well, the device may additionally or exclusively propel itself via the nozzles 502 or equivalent propellers, as disclosed above.

In an embodiment, the device 100 may be lowered a certain distance into of the tubular channel 199 by gravity, e.g. until the angle between the tubular channel 199 and vertical exceeds a certain angle, such as 60 degrees, in which the gravitational force in most cases is not high enough to overcome the friction between the fluid and the device 100. From this point of, the device 100 may propel itself via one or more of the above disclosed means e.g. the jet nozzle means 501 or propellers and/or the flexible member 109.

In an embodiment, the device 100 may be connected to a tractor which may move a distance into the tubular channel 199, e.g. to an area of interest of a user of the device 100, and subsequently, the device 100 may be released from the tractor in order to propel itself via one or more of the above disclosed means e.g. the jet nozzle means 501 or propellers and/or the flexible member 109.

In an embodiment, the device 100 may be connected to a drilling assembly via a wire. The drilling assembly may be positioned in proximity to the external communication unit 102A (e.g. containing the external communication unit 102A) at the surface of the tubular channel 199. Alternatively, the drilling assembly may be positioned in the tubular channel 199.

Figure 8:
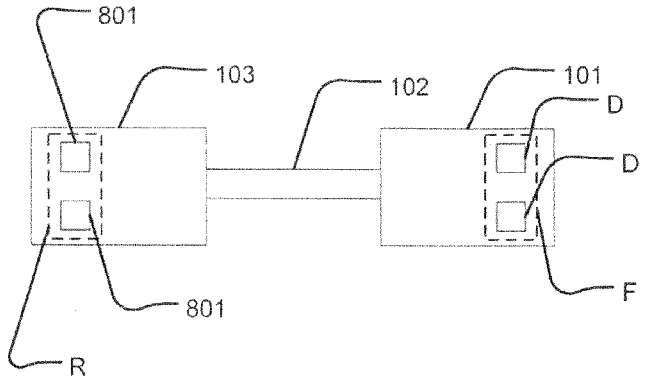
FIG. 8 shows an embodiment of a device for examining a tubular channel comprising a front and a rear array of detectors.

FIG. 8 shows an embodiment of a device 100 for examining a tubular channel comprising a front F and a rear R array of detectors. The device 100 of FIG. 8 may comprise the technical features described under FIGS. 1 and/or 2 and/or 3 and/or 4 and/or 5 and/or 6 and/or 7.

In an embodiment of FIG. 8, each of the front and rear arrays of detectors comprise a number of ultrasonic distance sensors.

The front array of ultrasonic distance sensors F may, for example, comprise the number of ultrasonic distance sensors D contained in the cylindrical part 104 of the first part 101, e.g. in the circumference of the cylindrical part 104 and thereby providing data representing a distance between the cylindrical part 104 and the surrounding tubular channel 199 as disclosed in relation to FIG. 1. For example, the number of ultrasonic distance sensors D may be 10.

The rear array R of ultrasonic distance sensors 801 may comprise a number of ultrasonic distance sensors 801, e.g. 10 ultrasonic distance sensors. The number of ultrasonic distance sensors 801 may provide data representing a distance to e.g. the surrounding tubular channel 199. The ultrasonic distance sensors 801 may be contained within the third part 103. For example, the 10 ultrasonic distance sensors 801 may be contained in a cylindrical part of the third part 103, e.g. in a circumference of the cylindrical part and thereby providing data representing a distance between the cylindrical part and the surrounding tubular channel 199.

The distance between the front F and rear R arrays of ultrasonic distance sensors is known and may, for example be XY mm e.g. 300 mm.

As the device 100 travels in the tubular channel, the front array and the rear array of ultrasonic distance sensors records respective values of the tubular channel. For example, the front and rear array may determine the diameter of the tubular channel.

The front and rear arrays of ultrasonic sensors may be connected to the PLC e.g. via a wire and an analogue-to-digital (ND) converter and a multiplexer 109.

Further, when the PLC has received a measurement of a diameter of the tubular channel from the front array, it may start a tinier such as a clock or the like. When the PLC receives an identical or substantially identical measurement (e.g. 9 out of 10 ultrasonic sensors in the rear array measures similar values as the sensors in the front array), the PLC determines a time-interval between the reception of the front array measurement and the rear array measurement. Based on the distance between the front and rear arrays and the time-interval, the PLC is able to determine a velocity of the device 100 in the tubular channel.

In an embodiment of FIG. 8, each of the front and rear arrays of detectors comprise a number of image sensors. Additionally, the device may comprise a light emitting diode in proximity to each of the image sensors.

The distance between the front F and rear R arrays of image sensors is known and may, for example be XY mm e.g. 300 mm.

For example, the front array may transmit a recorded image to the PLC. The PLC may perform at least one image processing e.g. geometric hashing to determine at least one parameter representative of the image.

Subsequently, the PLC may perform similar image processing on images received from the rear array, and when a match is found between an image from the front array and an image from the rear array, a time-interval between reception of the two images is determined and based on the distance between the front and rear arrays and the time-interval, the PLC is able to determine a velocity of the device 100 in the tubular channel.

In an embodiment, the device 100 may comprise a pitot tube enabling a precise determination of fluid velocity relative to the device 100.

Figure 9:
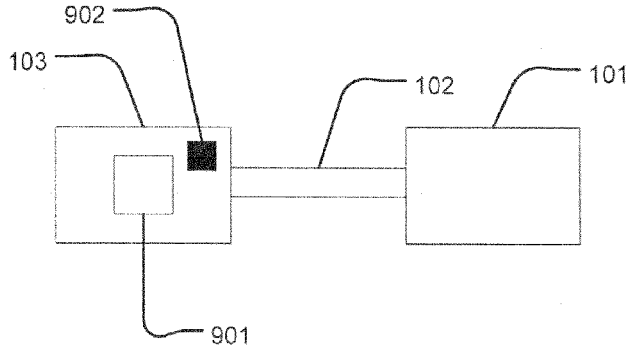
FIG. 9 shows an embodiment of a device for examining a tubular channel comprising a second high pressure cylinder.

FIG. 9 shows an embodiment of a device 100 for examining a tubular channel comprising a second high pressure cylinder 901. The device 100 of FIG. 9 may comprise the technical features described under FIGS. 1 and/or 2 and/or 3 and/or 4 and/or 5 and/or 6 and/or 7 and/or 8.

The high pressure cylinder 901 may contain a gas such as for example nitrogen or the like. Further, the device 100 may be hermetically sealed. Further, the device 100 may be hollow. Additionally further, the second high pressure cylinder may be communicatively coupled to the PLC such that the PLC may control the second high pressure cylinder 901.

The device may further comprise a second pressure sensor 902 communicatively coupled to the PLC.

An external pressure measured by the pressure sensors P and an internal pressure measured by the pressure sensor 902 may be transmitted to the PLC. Based on the difference between the measured pressures, the PLC may control the second high pressure cylinder 901 to emit gas to thereby increase the internal pressure and thus in order to reduce the difference between the measured pressures. In an embodiment, the PLC controls the second high pressure cylinder 901 to emit gas to equalize or substantially equalize (e.g.

internal pressure is within 5% of the external pressure) the internal pressure and the external pressure.

By equalizing or substantially equalizing the internal and external pressures enables the walls of the device to be thin and light weight because they are not subjected to a large pressure differential.

Figure 10:
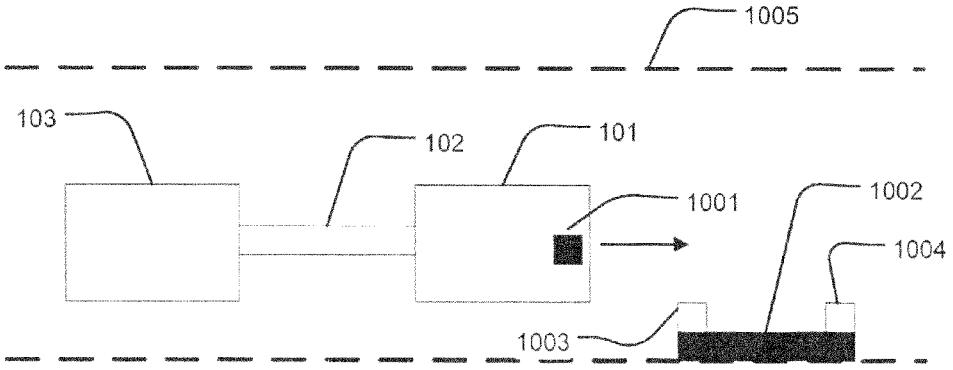
FIG. 10 shows an embodiment of a device for examining a tubular channel comprising a compass.

FIG. 10 shows an embodiment of a device 100 for examining a tubular channel comprising a compass 1001. The device 100 of FIG. 10 may comprise the technical features described under FIGS. 1 and/or 2 and/or 3 and/or 4 and/or 5 and/or 6 and/or 7 and/or 8 and/or 9.

The device 100 may comprise a compass 1001 positioned in the front of the device 100 e.g. in the semi-spherical cap part 105 of the first part 101 as illustrated in FIG. 1. The compass may be communicatively coupled e.g. via an electric wire or Bluetooth to the PLC and may enable detection of e.g. one or more small magnets 1003, 1004 placed in one or more structures contained in the tubular channel.

For example, the structure may be a blocking system, for instance in the form of a patch 1002, placed by a tractor in order to prevent water leaking into a hydrocarbon producing well 1005. The blocking system 1002 may contain a first magnet 1003 e.g. aligned such that the south (S) pole of the magnet is pointing radially into the well and positioned such as to demark the beginning of the blocking system seen from the entrance of the well. The blocking system may contain a second magnet 1004 e.g. aligned such that the north (N) pole of the magnet is pointing radially into the well and positioned such as to demark the end of the blocking system seen from the entrance of the well.

When the device 100 passes the beginning of the blocking system 1002, the compass 1001 will change its orientation due to the first magnet 1003 and indicate that the device 100 passes a magnetic element e.g. a part of a blocking system 1002. When the device 100 passes the end of the blocking system 1002, the compass 1001 will change its orientation due to the presence of the second magnet 1004 and indicate that the device 100 passes a magnetic element e.g. a part of a blocking system 1002.

In an embodiment, the blocking system may comprise a number of magnets, e.g. three magnets, in each end in order to be able to provide a specific signal for the beginning and end of the blocking system. For example, the three magnets placed in the beginning of the blocking system be aligned such that the south pole of the first magnet, the north pole of the second magnet and the south pole of the third magnet are pointing radially into the well 1005. Additionally, for example, the three magnets placed in the end of the blocking system 1002 may be aligned such that the north pole of the first magnet, the south pole of the second magnet and the north pole of the third magnet are pointing radially into the well 1005. Thereby, precise identification of the beginning and end of the blocking system 1002 is possible. Other combinations of number of magnets and alignment of the magnets is possible such as e.g. SSS-poles at the beginning and NNN-poles at the end of the blocking system.

In an embodiment, the PLC may utilize the information regarding blocking system beginning and end to e.g. control speed and position of the device 100 in the well.

Figure 11:
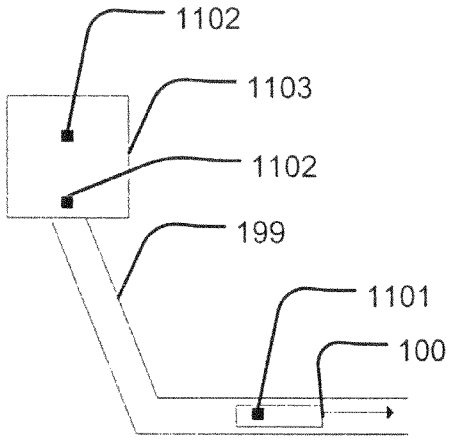
FIG. 11 shows an embodiment of a device for examining a tubular channel comprising a clock.

FIG. 11 shows an embodiment of a device 100 for examining a tubular channel comprising a clock 1101. The device 100 of FIG. 11 may comprise the technical features described under FIGS. 1 and/or 2 and/or 3 and/or 4 and/or 5 and/or 6 and/or 7 and/or 8 and/or 9 and/or 10.

The device may comprise a clock 1101 e.g. contained in the PLC. Another clock 1102 may be contained in a wellhead 1103 positioned at the entrance to the tubular channel 199. Additionally, an ultrasonic transducer 1104 may be placed in the wellhead 1103. The clock 1102 and the ultrasonic transducer 1104 may both form part of or pertain to a control module 102A placed outside the wellbore.

The clock 1101 in the device 100 and the clock 1102 in the wellhead 1103 may be synchronized. Further, the ultrasonic transducer 1104 may be programmed to transmit an ultrasonic signal into the tubular channel 199 towards the device 100 at predetermined time-intervals e.g. 1 minute after the device 100 has left the wellhead, 2 minutes after, etc.

The device 100 may contain a log e.g. in the PLC including information on when the signals are transmitted into the tubular channel 199 by the ultrasonic transducer 1104. Further, the device 100 may determine the time-difference between the time of reception of a signal and the actual transmission time of the signal from the transducer 1104. Knowing the speed of sound in the fluid in which the device is currently moving, the PLC may determine the distance travelled by the device 100 at the time of reception of the signal from the transducer 1104 by multiplying the time-difference with the speed of sound in the fluid. For example, if the time difference between the time of transmission and time of reception of a signal is determined to be 5 seconds and the fluid is water in which the sound speed is approximately 1484 m/s then the device has travelled approximately 7420 m in the tubular channel 199. The device 100 may transmit the distance travelled to the external communication unit 102A via the acoustic modem 108.

In an embodiment, the external communication unit 102A may calculate the velocity of the fluid leaving the well. For example, the external communication unit may know the frequency at which the device 100 transmits (via e.g. the acoustic modem 108) a signal representing the distance travelled by the device 100. Subsequently, the external communication unit 102A may determine the Doppler shift in the frequency of the signal received and from the Doppler shift the velocity of the fluid in which the signal from the device 100 is transmitted may be determined.

In the way described above, a sound signal may be communicated between the data acquisition module 100 and the control module 102A located outside the wellbore 199, whereby the sound signal may be transmitted through the fluid present in the wellbore, and the position of a fracture in the wall of the wellbore may determined at least on the basis of said sound signal received by the control module or by the data acquisition module and at least on the basis of a time difference between the time of emission of the sound signal and the time of reception of the sound signal.

Device and System for Moving in a Tubular Channel

FIGS. 12 to 19 illustrate embodiments according to the invention of the employment of a well tractor for advancement through a wellbore in order to, on the basis of data acquired by a data acquisition module (such as exemplified by the embodiments of FIGS. 1 to 11), place at least one blocking system in the wellbore at the location of a fracture in the wall. Although the embodiments of the well tractor discussed in the following comprise several features, many of these features may not be necessary in order to carry out the method according to the invention or may not necessarily be comprised by the system according to the invention. According to the invention, the at least one blocking system may in fact be placed in the wellbore by means of other tools than a well tractor, such as for example by means of coiled tubing.

The person skilled in the art will understand that the following embodiments of a well tractor present examples of a well tractor that may be employed to carry out the invention, but that several other embodiments are possible within the scope of the invention.

Figure 12:
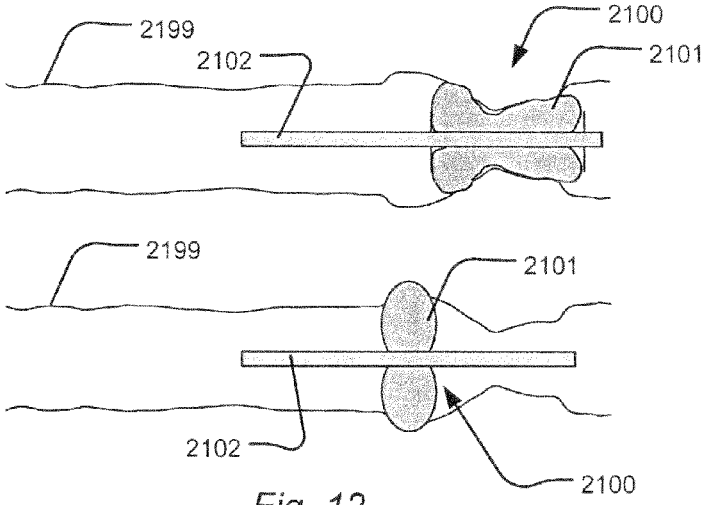
FIG. 12 shows a sectional view of a device 2100 for moving in a tubular channel 2199.

FIG. 12 shows a sectional view of a well tractor in the form of a device 2100 for moving in a tubular channel 2199. In the above and below, a tubular channel may be exemplified by a borehole, a pipe, a fluid-filled conduit, and an oil-pipe.

The tubular channel 2199 may contain a fluid such as hydrocarbons, e.g. petroleum oil hydrocarbons such as paraffins, naphthenes, aromatics and asphaltics.

The device 2100 comprises inflatable and deflatable gripping means 2101. The inflatable and deflatable gripping means 2101 may, for example, be flexible bellows which may adapt to the wall condition of the tubular channel 2199. The gripping force exerted by the device 2100 on the wall of the tubular channel 2199 depends on the pressure of the flexible bellows 2101 on the wall of the tubular channel 2199. The device 2100 further comprises a part 2102 to which the inflatable and deflatable gripping means 2101 may be fastened and which may be at least partially encased by the inflatable and deflatable gripping means 2101. For example, the part 2102 may be rod-shaped and the inflatable and deflatable gripping means 2101 may be shaped as a tubeless tire and thus, when fastened to the rod-shaped part 2102 e.g. via glue or the like, encase a part of the rod-shaped part 2102.

Figure 13:
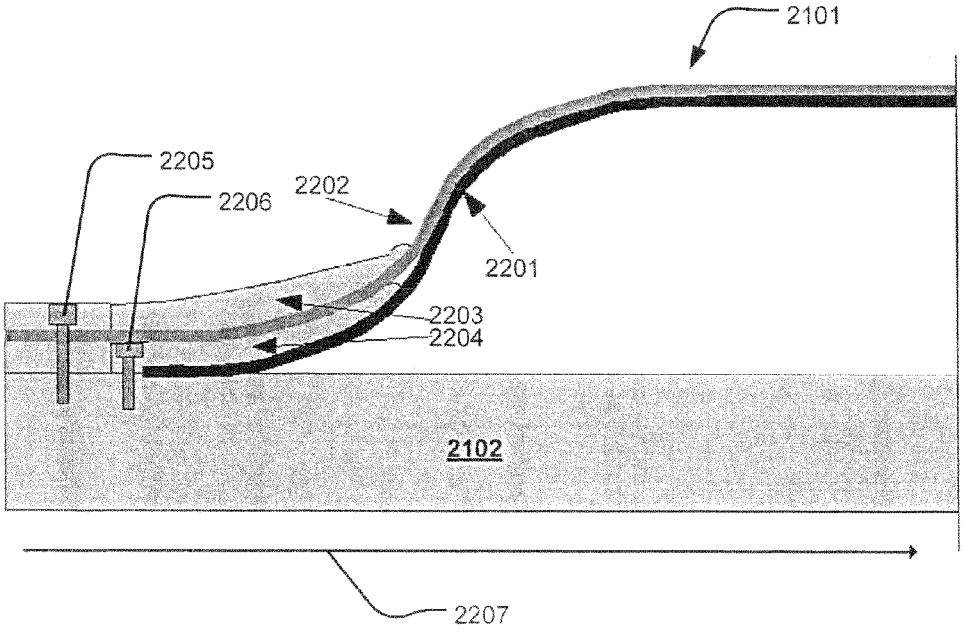
FIG. 13 shows a sectional view of an inflatable and deflatable gripping means 2101.

FIG. 13 shows a sectional view of the inflatable and deflatable gripping means 2101. The flexible bellows 2101 may comprise a woven texture bellows 2202, e.g. made of woven aramid and/or Kevlar, and a pressure-tight flexible bellows 2201, e.g. made of a rubber or other flexible and airtight/pressure-tight/fluid-tight material. The pressure-tight flexible bellows 2201 is encased by the woven texture 2202. The flexible pressure-tight bellows 2201 provides the pressure integrity of the inflatable and deflatable gripping means 2101.

The pressure-tight flexible bellows 2201 may be clamped to the part 2102 by a first curved, e.g. parabolic-shaped, ring 2204 providing a gradual clamping force along the horizontal axis 2207 of the part 2102, whereby pinching and subsequent rupture of the pressure-tight flexible bellows 2201 due to an internal pressure of the pressure-tight flexible bellows 2201 may be prevented. The first curved ring 2204 may be clamped to the part 2102 by a fastening means 2206 such as a screw, nail or the like. The first curved ring 2204 must be pressure tight i.e. must provide sealing of the pressure-tight flexible bellows 2201 to the part 2102 but may have any clamping strength.

The woven texture bellows 2202 may be clamped between the first curved ring 2204 and a second curved, e.g. parabolic-shaped, ring 2203. The first and the second curved rings thus provide a gradual clamping force along the horizontal axis 2207 of the part 2102, whereby pinching and wear of the woven texture bellows 2202 may be prevented. The second curved ring 2203 may be clamped to the part 2102 by a fastening means 2205 such as a screw, nail or the like. The second curved ring 2203 may be positioned on top of the first curved ring 2204 as illustrated in FIG. 13. The second curved ring 2202 must be strong in order to maintain the shape of the woven texture, but may provide any pressure tightness i.e. it is not required to be pressure-tight.

The woven texture bellows 2202 may provide a shape of the pressure-tight flexible bellows 2201, so that the pressure-tight flexible bellows 2201 may not be over-stressed and/or deformed beyond its allowable elastic range. Further, the woven texture bellows 2202 provide physical strength and wear resistance to the pressure-tight flexible bellows 2201.

The curved rings may further provide shape stability of the inflatable and deflatable gripping means 2101. Further, the curved rings may prohibit sharp edges such that multiple inflations/deflations of the inflatable and deflatable gripping means 2101 can be achieved.

In an embodiment, the woven texture 2202 may be covered with ceramic particles in order to provide wear resistance of the woven texture 2202.

Figure 14:
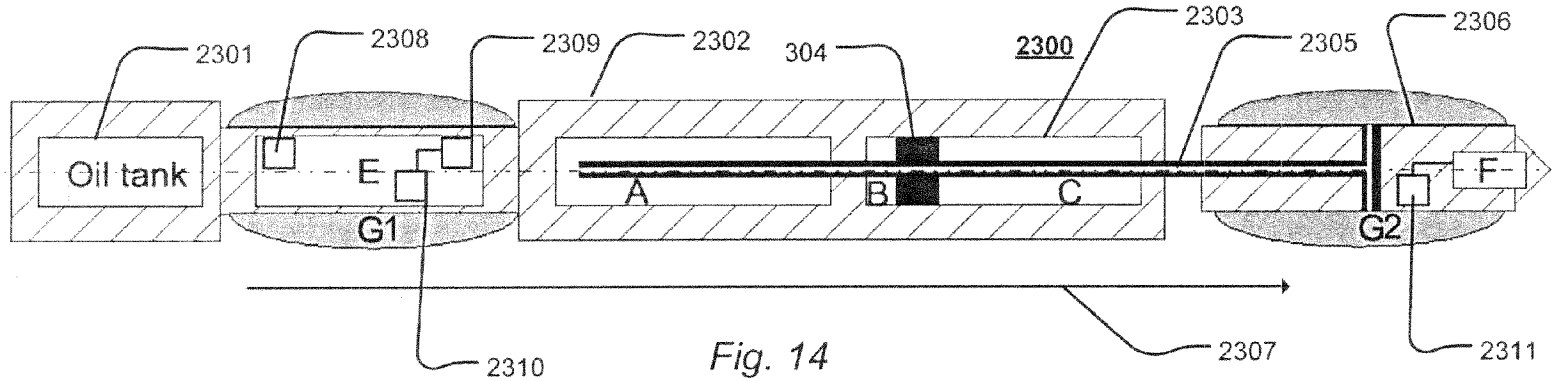
FIG. 14 shows a sectional view of an embodiment of a device 2100 for moving in a tubular channel 2199 comprising two inflatable and deflatable gripping means, G1, G2.

FIG. 14 shows a sectional view of an embodiment of a device 2100 for moving in a tubular channel 2199 comprising two inflatable and deflatable gripping means, G1, G2. The device 2100 comprises a hydrophore 2301 attached to a pump section E comprising a pumping unit 2308 and a programmable logic controller (PLC) 2309.

The hydrophore 2301 may, for example, be a rubber bellows encased or substantially encased in a steel cylinder. The hydrophore 2301 may contain oil (or any other pumpable fluid). The hydrophore prevents the oil from bursting out e.g. when the pressure changes and/or when the temperature changes. For example, the temperature at the entrance of the tubular channel 2199 may be at −10 degrees C. and in the tubular channel 2199 the temperature may be 2100 degrees C. Additionally for example, the pressure at the entrance of the tubular channel 2199 may be 1 bar and in the tubular channel 2199 the pressure may be 250 bar.

The pump section E may further comprise a battery providing power to the device 2100. Alternatively or additionally, the device 2100 may comprise a plug/socket for receiving a wireline, through which the device 2100 may be powered. For example, the plug/socket may be located on the oil tank 2301 e.g. on the end facing away from the pump section E.

The pumping unit 2308 may, for example, comprise a fixed displacement bidirectional hydraulic pump.

The PLC 2309 may be communicatively coupled, e.g. via an electric wire, to a short-range radio unit 2310, e.g. a Bluetooth unit.

Further attached to and partly or wholly encasing the pump section E is a first inflatable and deflatable gripping means G1. The first inflatable and deflatable gripping means G1 may be of the type disclosed under FIG. 13. The first inflatable and deflatable gripping means G1 may comprise a fluid such as an oil or the like which may be pumped by the pumping unit 2308.

Further attached to the pump section E is a cylinder section 2302. The cylinder section 2302 comprises a reservoir A, e.g. an oil reservoir, and a pressure chamber 2303 comprising a first piston pressure chamber B and a sec- and piston pressure chamber C.

The cylinder section 2302 further comprises a piston 2304 attached to a connecting rod 2305. A first end of the connecting rod 2305 is located in the oil reservoir A and the other end of the connecting rod 2305 is attached to a sensor section 2306. The sensor section 2306 is thus attached to the device 2100 via the connection rod 2305. The connection rod 2305 may translate along the longitudinal axis 2307 of the device 2100. The connecting rod 2305 may be hollow i.e. enabling e.g. a fluid to pass through it. The piston 2304 is located in the pressure chamber 2303.

The oil reservoir and the first piston pressure chamber B and the second piston pressure chamber C may comprise a pumpable fluid, such as an oil or the like, which may be pumped by the pumping unit 2308. The oil reservoir A may be sealed from the pressure chamber 2303.

Attached to and partly or wholly encasing the sensor section 2306 is a second inflatable and deflatable gripping means G2. The second inflatable and deflatable gripping means G2 may be of the type disclosed under FIG. 13. The second inflatable and deflatable gripping means G2 may comprise a fluid such as an oil or the like which may be pumped by the pumping unit 2308.

Further, the sensor section 2306 may comprise a number of sensors F. For example, the sensor section 2306 may contain a number of ultrasonic sensors for determining the relative fluid velocity around the sensor section 2306. An ultrasonic sensor may be represented by a transducer. The ultrasonic sensors may be contained within the sensor section 2306. The ultrasonic sensors may provide data representing a fluid velocity.

Additionally, the sensor section 2306 may, for example, include a number of distance sensors. The number of ultrasonic distance sensors may provide data representing a distance to e.g. the surrounding tubular channel 2199. The ultrasonic distance sensors may be contained within the sensor section 2306. The ultrasonic distance sensors may provide data representing a distance between the sensor section 2306 and the surrounding tubular channel 2199 i.e. data representing a radial view. Further, the ultrasonic distance sensors may provide data representing a distance between the sensor section 2306 and e.g. potential obstacles, such as cave-ins/wash-outs, in front of the device 2100 i.e. data representing a forward view.

The ultrasonic sensors and ultrasonic distance sensors of the sensor section 2306 may be probing the fluid surrounding the device 2100 and the tubular channel 2199 through e.g. glass windows such that the sensors are protected against the fluid flowing in the tubular channel 2199.

The sensor section 2306 may additionally comprise a pressure sensor. The pressure sensor may be contained in the sensor section 2306. The pressure sensor may provide data representing a pressure of a fluid surrounding the device 2100.

Further, the sensor section 2306 may contain a resistivity meter for measuring the resistivity of the fluid surrounding the device 2100. The resistivity meter may be contained in the sensor section 2306. The resistivity meter may provide data representing resistivity of the fluid surrounding the device 2100.

Further, the sensor section 2306 may contain a temperature sensor for measuring the temperature of the fluid surrounding the device 2100. The temperature sensor may be contained in the sensor section 2306. The temperature sensor may provide data representing a temperature of the fluid surrounding the device 2100.

The sensor section 2306 may additionally comprise a position-determining unit providing data representing the position of the device 2100, and thus enabling position tagging of the data from the abovementioned sensors. The position tagging may, for example, be performed with respect to e.g. the entrance of the tubular channel 2199.

In an embodiment, the position-determining unit may comprise a plurality of gyroscopes Gyro, for example three gyroscopes (one for each three dimensional axis), and a compass Compass and a plurality of accelerometer G-forces, for example three accelerometers (one for each three dimensional axis), and a tiltmeter (inclinometer) Tilt meter.

The sensor section 2306 may further contain a short-range radio unit 2311, such as a Bluetooth unit, capable of establishing a short-range radio link to the PLC 2309. Further, the short-range radio unit may be communicatively coupled, e.g. via an electric wire, to one or more of the abovementioned sensors and thereby the sensor section 2306 is enabled to transmit data from the one or more sensors F to the PLC 2309 via the short-range radio link.

The PLC 2309 may be communicatively coupled, e.g. via electric wires, to the pumping unit 2308 whereby the PLC is able to control the pumping unit 2308 e.g. by transmitting a control signal to the pump 2400 of the pumping unit 2308.

Figure 15:
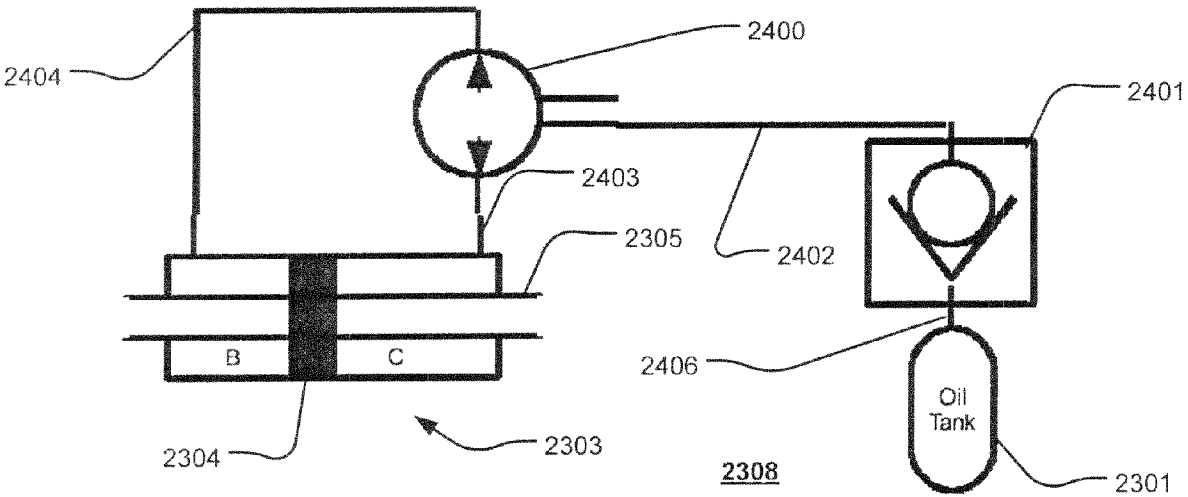
FIG. 15 shows a schematic diagram of an embodiment of a pumping unit 2308 adapted to translate the connecting rod 2305.

FIG. 15 shows a schematic diagram of an embodiment of a pumping unit 2308 adapted to translate the connecting rod 2305. The pumping unit of FIG. 15 may be contained in a device such as disclosed with respect to FIGS. 14 and/or 17 and/or 19.

The pumping unit 2308 comprises the pump 2400 of the pump section E. Further, the pumping unit 2308 comprises a back-flow valve 2401 and the oil tank 2301. The pump 2400, e.g. a low pressure pump, is fluidly coupled, e.g. via a pipe 2402, to the back-flow valve 2401, and via the valve 2401 and a pipe 2402 to the oil tank 2301. Additionally, the pump 2400 is fluidly coupled, e.g. via a pipe 2403, to the second piston pressure chamber C and, e.g. via a pipe 2404, to the first piston pressure chamber B of the pressure chamber 2303.

The pumping unit 2308 is able to, e.g. in response to a control signal from the PLC 2309, translate the piston 2304 and thereby the connecting rod 2305 along the longitudinal axis 2307 of the device 2100.

For example, to translate the piston 2304 towards the first piston pressure chamber B i.e. to the left in FIG. 15, the PLC 2309 may transmit a control signal to the pump 2400 such that the pump 2400 starts to pump the fluid from the first piston pressure chamber B to the second piston pressure chamber C via the pipe 2404. Thereby, the first piston pressure chamber B is depressurized and the second piston pressure chamber C is pressurized and thereby, the piston moves towards the first piston pressure chamber B.

For example, to translate the piston 2304 towards the second piston pressure chamber C i.e. to the right in FIG. 15, the PLC 2309 may transmit a control signal to the pump 2400 such that the pump 2400 starts to pump the fluid from the second piston pressure chamber C to the first piston pressure chamber B via the pipe 2404. Thereby, the second piston pressure chamber C is depressurized and the first piston pressure chamber B is pressurized and thereby, the piston moves towards the second piston pressure chamber C.

The PLC 2309 may transmit a further control signal to the pump 2400 in order to stop the pump 2400 when the piston 2304, and thereby also the connecting rod 2305, has been translated a distance determined by the PLC based on the data received from the one or more sensors. Alternatively or additionally, the pump 2400 may receive a stop signal from the PLC 2309 when the piston 2304 reaches an end wall of the pressure chamber 2303 e.g. by having a switch, e.g. a pushbutton switch, attached to the inside of each of the end walls of the pressure chamber 2303 detecting when the piston 2304 touches one of the end walls. The switches may be communicatively coupled, e.g. via electric wires, to the PLC 2309.

Figure 16:
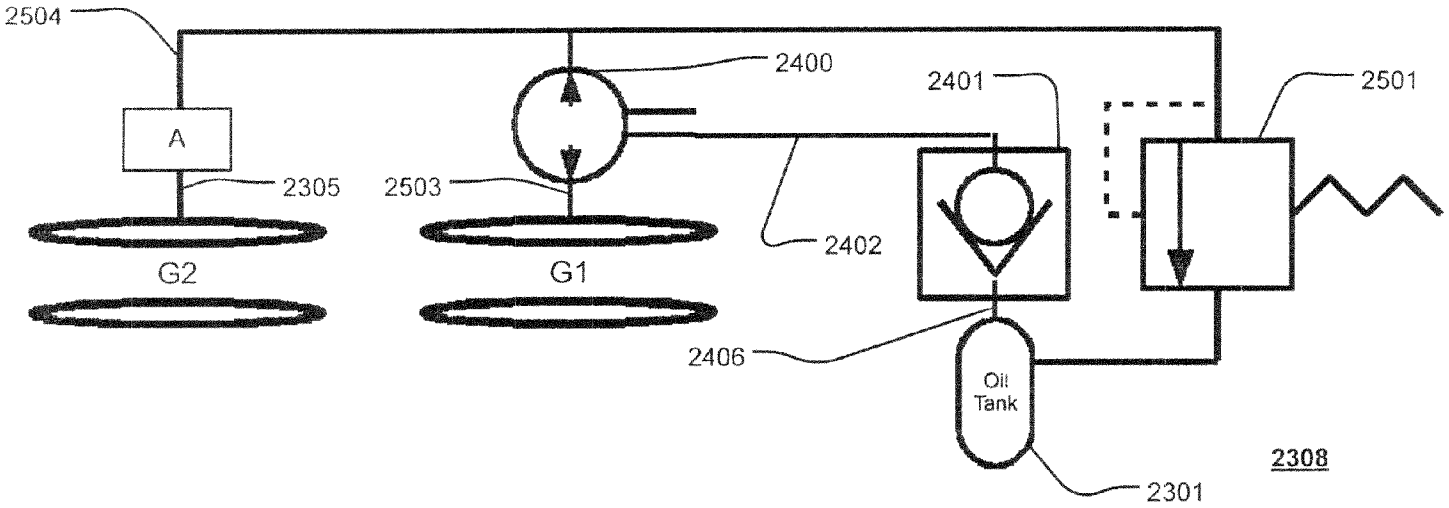
FIG. 16 shows a schematic diagram of an embodiment of a pumping unit 2308 adapted to inflate and/or deflate the first and second inflatable and deflatable gripping means G1, G2.

FIG. 16 shows a schematic diagram of an embodiment of a pumping unit 2308 adapted to inflate and/or deflate the first and second inflatable and deflatable gripping means G1, G2. The pumping unit of FIG. 16 may be contained in a device such as disclosed with respect to FIGS. 14 and/or 17 and/or 19.

The pumping unit 2308 comprises the pump 2400 of the pump section E. Further, the pumping unit 2308 comprises the back-flow valve 2401 and the oil tank 2301. Further, the pumping unit 2308 may comprise a pressure-relief valve

2501, the oil reservoir, the connecting rod 2305 and the first and second inflatable and deflatable gripping means G1, G2.

The pressure-relief valve 2501 may, for example, determine the pressure in the pumping unit 2308.

The pump 2400, e.g. a low pressure pump, is fluidly coupled, e.g. via a pipe 2402, to the back-flow valve 2401, and via the valve 2401 and a pipe 2406 to the oil tank 2301.

Additionally, the pump 2400 is fluidly coupled, e.g. via a pipe 2503, to the first inflatable and deflatable gripping means G1 and, e.g. via a pipe 2504, to the second inflatable and deflatable gripping means G2. The pipe 2504 may further fluidly couple the pump 2400 to the pressure-relief valve 2501. The pressure-relief valve 2501 may be fluidly coupled via e.g. a pipe 2505 to the oil tank 2301.

The pumping unit 2308 is able to, e.g. in response to a control signal from the PLC 2309, inflate one of the inflatable and deflatable gripping means while deflating the other.

For example, to inflate the first inflatable and deflatable gripping means G1, the PLC 2309 may transmit a control signal to the pump 2400 such that the pump 2400 starts to pump the fluid from second inflatable and deflatable gripping means G2 to the first inflatable and deflatable gripping means G1 via the connecting rod 2305, the oil reservoir A and the pipe 2504. Thereby, the second inflatable and deflatable gripping means G2 deflates while the first inflatable and deflatable gripping means G1 inflates.

For example, to inflate the second inflatable and deflatable gripping means G2, the PLC 2309 may transmit a control signal to the pump 2400 such that the pump 2400 starts to pump the fluid from first inflatable and deflatable gripping means G1 to the second inflatable and deflatable gripping means G2 via the pipe 2504, the oil reservoir A and the connecting rod 2305. Thereby, the first inflatable and deflatable gripping means G1 deflates while the second inflatable and deflatable gripping means G2 inflates.

The PLC 2309 may transmit a further control signal to the pump 2400 in order to stop the pump 2400 when the inflatable and deflatable gripping means being inflated has a volume providing a sufficient grip on the wall of the tubular channel. The sufficient grip on the tubular channel may, for example, be determined by the pressure relief valve 2501 i.e. as long as the valve is close, the pump 2400 pumps from one inflatable and deflatable gripping means to the other inflatable and deflatable gripping means. Once the pressure-relief valve 2501 opens, the pump pumps from the deflating inflatable and deflatable gripping means to the oil tank via the pressure relief valve 2501.

The pressure relief valve 2501 may be communicatively coupled to the PLC 2309 e.g. via a wire. Once the pressure relief valve 2501 opens, it may transmit a control signal to the PLC 2309 which subsequently transmits a control signal to the pump 2400 stopping the pump 2400. Once the pressure in the pumping unit 2500 reaches the pressure relief valve's reseating pressure, the pressure relief valve closes again.

Figure 17:
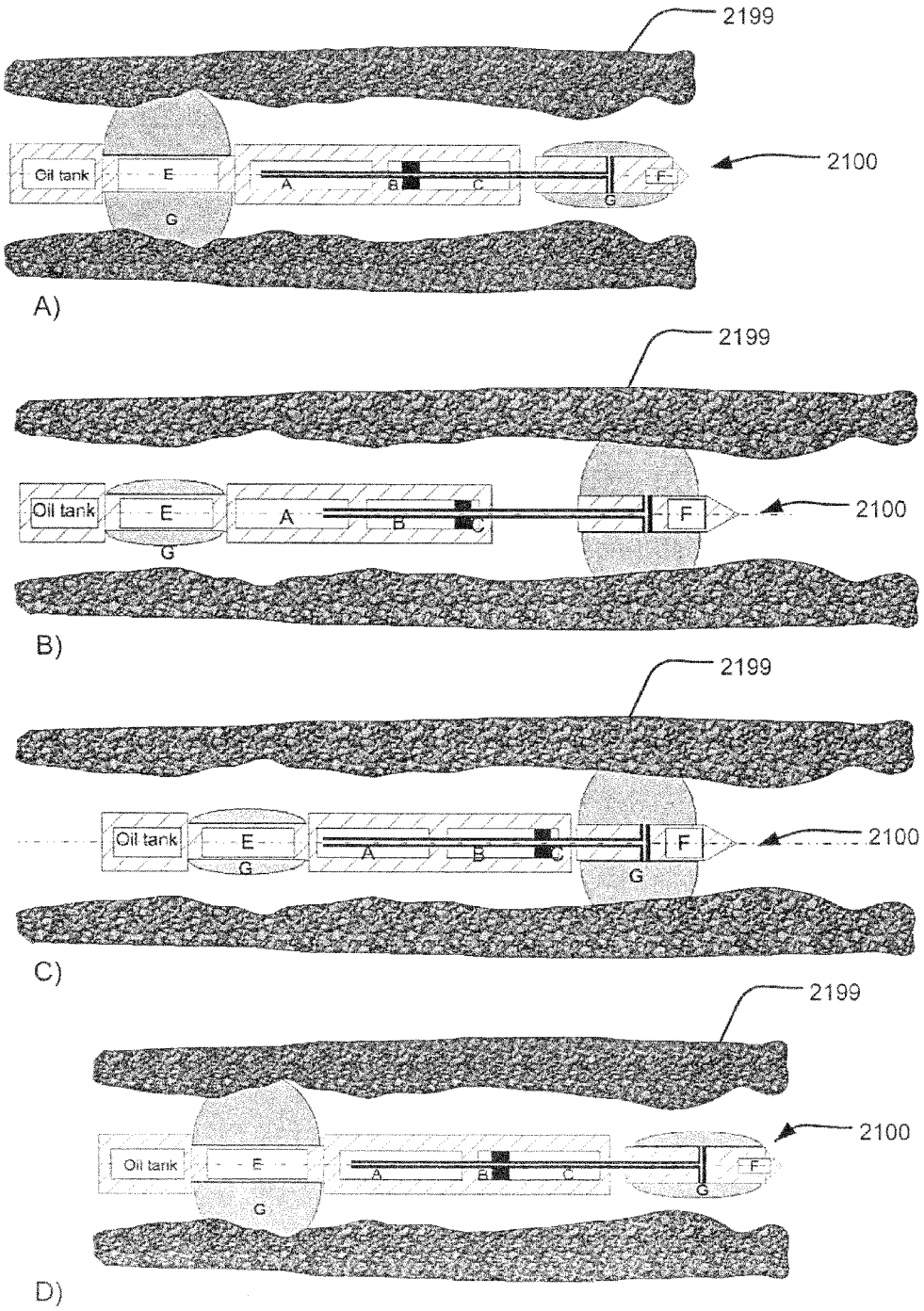
FIG. 17 shows a method of moving the device 2100 in a tubular channel 2199.

FIG. 17 shows a method of moving the device 2100 in a tubular channel 2199.

Figure 18:
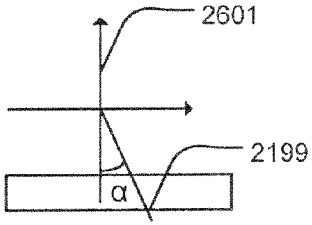
FIG. 18 shows the angle between the tubular channel and vertical.

In a first step, the device 2100, e.g. containing a load such as a blocking system or the like, may be moved into the tubular channel by a wireline lubricator. The device 2100 may be moved in such a way as long as the angle•, as shown in FIG. 18, between the tubular channel 2199 and vertical 2601 is smaller than 60 degrees. When the angle•becomes equal to or larger than 60 degrees, the friction between the device 2100 and the tubular channel 2199 and/or the fluid in the tubular channel 2199 may be larger than the gravitational pull in the device 2100 thus preventing the device 2100 from moving further in this way. When moving the device 2100 via a wireline lubricator, both the first and the second inflatable and deflatable gripping means G1, G2 may be deflated in order to ease movement of the device 2100 through the tubular channel 2199.

Thus, in a second step, the device is powered up comprising starting the sensors F in the sensor section 2306. The power-up may further comprise a test of all the sensors and communication between the short-range radio units 2310 and 2311.

In a third step as illustrated in FIG. 17 A), the first inflatable and deflatable gripping means G1 are inflated. In the case where the device 2100 has just powered up, both inflatable and deflatable gripping means G1, G2 are deflated and therefore, the inflation is performed by pumping fluid from the oil tank 2301 via pipe 2406, back flow valve 2401, pipe pump 2308, and pipe 2503 into inflatable and deflatable gripping means G1.

In a fourth step, the sensor section 2306 is translated (pushed) to the right by pressurizing the first piston pressure chamber B and depressurizing the second piston pressure chamber C as disclosed above with respect to FIG. 15.

In a fifth step as illustrated in FIG. 17 B), the second inflatable and deflatable gripping means G2 are inflated and the first inflatable and deflatable gripping means G1 are deflated as disclosed above with respect to FIG. 16.

In a sixth step as illustrated in FIG. 17 C), the oil tank 2301, the pump section E and the cylinder section 2302 are translated (pulled) to the right by pressurizing the second piston pressure chamber C and depressurizing the first piston pressure chamber B as disclosed above with respect to FIG. 15.

In a seventh step as illustrated in FIG. 17 D), the first inflatable and deflatable gripping means G1 are inflated and the second inflatable and deflatable gripping means G2 are deflated as disclosed above with respect to FIG. 16.

The above steps, step seven, step four, step five and step six, provides a method of moving the device 2100 in a tubular channel 2199 once one of the inflatable and deflatable gripping means G1, G2 have been inflated.

In an embodiment, the device 2100 may move in reverse of the above described direction. In the event where the device 2100 is powered through and/or connected to a wireline, the wireline must be pulled out of the tubular channel 2199 at the same velocity or approximately the same velocity (e.g. within 1%) as the device 2100 moves through the tubular channel 2199.

In an embodiment, the hydrophore 2301, the pump section E, the cylinder section 2302 and the sensor section may have a cylindrical cross section. For example, the device 2100 with deflated inflatable and deflatable gripping means G1, G2 may have a diameter of approximately 4 inches (approximately 101.6 mm).

In an embodiment, based on the data received by the PLC 2309 from the sensor section 2306, e.g. from the ultrasonic distance sensors, the PLC 2309 may determine by calculation whether the tubular channel 2199 in front of the device 2100 allows for moving the device 2100 further into the tubular channel 2199. Alternatively or additionally, based on the data received by the PLC 2309 from the sensor section 2306, e.g. from the ultrasonic distance sensors, the PLC 2309 may determine the direction in which the device 2100 is moving e.g. in the case of side tracks or the like in the tubular channel 2199. Thereby, the PLC may calculate a control signal for controlling the device 2100 based on the data received from one or more of the sensors F.

In an embodiment, the device 2100 may further comprise an acoustic modem enabling the device 2100 to transmit data received from one or more of the sensors F to a computer or the like equipped with an acoustic modem and positioned at the entrance of the tubular channel 2199.

In this way, a sound signal may be communicated between the well tractor 2100 and the control module 102A located outside the wellbore 199, 2199, 3006, whereby the sound signal may be transmitted through the fluid present in the wellbore, and the position of the well tractor may be determined at least on the basis of said sound signal received by the control module or by the well tractor and at least on the basis of a time difference between the time of emission of the sound signal and the time of reception of the sound signal.

In an embodiment, the device 2100 comprises two pumps, one for the pumping unit of FIG. 15 and one for the pumping unit of FIG. 16. Alternatively, the device 2100 may comprise a single pump which through valves serves the pumping unit of FIG. 15 and the pumping unit of FIG. 16.

Figure 19:
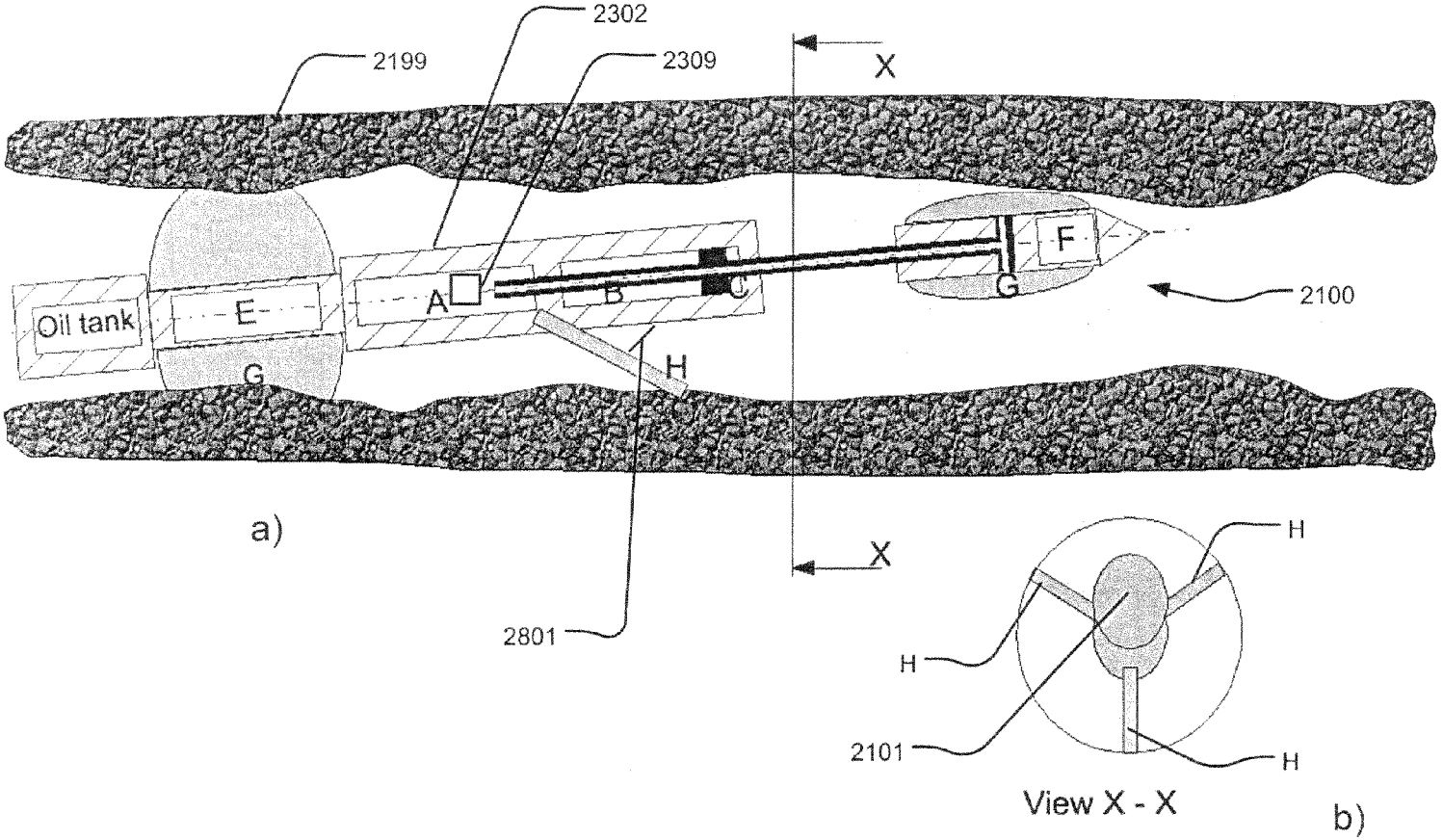
FIG. 19 shows a sectional view of an embodiment of a device for moving in a tubular channel comprising directional means.

FIG. 19 shows a sectional view of an embodiment of a device 2100 for moving in a tubular channel 2199 comprising directional means H. The device 2100 may comprise the technical features disclosed with respect to FIGS. 13 and/or 14 and/or 15 and/or 16. The directional means H may enable a steering of the device 2100 e.g. a change in orientation of the device 2100 with respect to a longitudinal axis of the tubular channel 2199 e.g. in order to move the device into a sidetrack of a fishbone well or the like.

As seen in FIG. 19 a), the directional means H may, for example, comprise a cylindrical element e.g. a rod or the like. A first end of the cylindrical element may be attached to the cylinder section 2302 via a ball bearing or a ball joint or a hinge or the like. The cylindrical element may act as a lever and may be connected to an actuator 2801 which may extend the other end of the lever in a direction radially outwards from the cylinder section 2302. The length of the directional means H may, for example, be approximately equal to the diameter of the tubular channel 2199 e.g. approximately 8.5inch±5%.

The actuator 2801 may be electrically coupled, e.g. via an electric wire, to the PLC 2309 enabling activation of the actuator via a control signal from the PLC 2309.

In an embodiment as seen in FIG. 19 b), the directional means may comprise three cylindrical elements H e.g. placed at a 120 degree separation along the circumference of the outer wall of the cylindrical section 2302 of the device 2100. Each of the cylindrical elements H may act as a lever attached at one end to the cylinder section and connected to an actuator 2801 able of extending the other end of the cylindrical element H radially outwards from the cylinder section 2302.

In an embodiment, the PLC 2309 may receive data, on which the control signal is calculated, from the sensors in the sensor section F. Alternatively, the PLC 2309 may receive a control signal via a wireline from the entrance of the tubular channel 2199.

The well tractor 2100 may pull at least one blocking system, for instance in the form of a patch, through the wellbore 199, 2199, 3006 to a location of a fracture in the wall, whereby the patch may be expanded until abutment against the wall of the wellbore and released from the well tractor.

Further, the well tractor 2100 may advance through a first patch 1002, 3000 already expanded and fixed in the wellbore 199, 2199, 3006 and pull a second patch 1002, 3000 through the first patch 1002, 3000. This procedure is illustrated in FIG. 32, whereby, however, only the first patch is shown. In FIG. 32, the second patch should be mounted on the running tool as illustrated in FIG. 31, in order to be pulled through the first patch that is already expanded and fixed in the wellbore.

Generally, in the above and the below, the inflatable and deflatable gripping means G1, G2, G of the devices disclosed with respect to FIGS. 12 and/or 14 and/or 17 and/or 19 may be of the type disclosed with respect to FIG. 13.

Blocking System and Method for Sealing Off a Part of a Wall in a Section of a Well Bore by Means of Such Apparatus FIGS. 20 to 30 illustrate embodiments of a blocking system in the form of a patch-type apparatus 3000 for sealing off a part of a wall according to the invention. According to the invention, the patch-type apparatus 3000 is, on the basis of data acquired by a data acquisition module (such as exemplified by the embodiments of FIGS. 1 to 11), by means of a tool (such as a well tractor exemplified by the embodiments of FIGS. 12 to 19), placed in the wellbore at the location of a fracture in the wall. Although the embodiments of the blocking system in the form of a patch-type apparatus discussed in the following comprise several features, many of these features may not be necessary in order to carry out the method according to the invention or may not necessarily be comprised by the system according to the invention. According to the invention, the at least one blocking system is adapted to be placed in the wellbore at the location of a fracture in the wall of the wellbore in order to seal off a part of the wall of the wellbore.

The person skilled in the art will understand that the following embodiments of a patch-type apparatus 3000 present examples of a blocking system that may be employed to carry out the invention, but that several other embodiments are possible within the scope of the invention. For instance, alternatively to a mechanical system such as the patch-type apparatus described in the following, a chemical substance, such as for instance a gypsum-based substance, may serve to block a fracture in a wall of a wellbore.

In an embodiment of a patch-type apparatus for sealing off a part of a wall 3005 in a section 3006 drilled into an earth formation and to be placed in the section 3006 drilled into the earth formation, the apparatus 3000 comprises a number of elongate members 3001 arranged substantially parallel along a closed curve, where adjacent elongate members 3001 are connected via a number of intermediate links 3002, each link 3002 being moveable relative to the elongate members 3001 it is attached to from an unlocked position to a locked position. FIGS. 20 and 21 shows a part of a net or cage of elongate members 3001 connected with intermediate links 3002 in collapsed configuration and FIG. 22 shows the same in an expanded position.

In a further embodiment the intermediate links 3002 can be locked in collapsed position.

In another embodiment the intermediate links 3002 are held in collapsed position during insertion of the apparatus 3000 by means of a flexible member 3003.

In yet an embodiment the flexible member 3003 is an outer bag or bellows 3003.

In another embodiment the patch-type apparatus 3000 for sealing off a part of a wall 3005 in a section 3006 drilled into an earth formation and to be placed in the section 3006 drilled into the earth formation, the length of the intermediate links 3002 and the number of elongate members 3001 are adapted to form an outer diameter of the apparatus in collapsed state, which outer diameter is smaller than the inner diameter of the apparatus being in an activated state as shown in FIGS. 23, 24 and 25. This makes it possible to introduce a collapsed apparatus into the section 3006 drilled into an earth formation through an existing tubing and also if necessary through an already positioned apparatus.

In a further embodiment of a patch-type apparatus 3000 for sealing off a part of a wall 3005 in a section 3006 drilled into an earth formation and to be placed in the section 3006 drilled into the earth formation, the elongate members 3001 are provided with locking means for holding the intermediate links 3002 in a position substantially perpendicular to the elongate members 3001. This provides a kind of stiff cage in expanded configuration. When the intermediate links 3002 are in locked position, meaning that they can not be moved in such a way that the distance between two neighbouring or two adjacent elongate members 3001 are reduced, they will provide the apparatus with a minimum collapse strength of the deployed device.

This is also achieved in an embodiment where a patch-type apparatus 3000 for sealing off a part of a wall 3005 in a section 3006 drilled into an earth formation and to be placed in the section 3006 drilled into the earth formation, has a locking member 3007 formed by a groove or ridge 3007 extending in a direction substantially perpendicular to the longitudinal direction of the elongate members 3001.

In an embodiment of an apparatus 3000 for sealing off a part of a wall 3005 in a section 3006 drilled into an earth formation and to be placed in the section 3006 drilled into the earth formation, an inflatable bag or bellows 3003 is arranged at the outer diameter of the apparatus to form a sealing member against the wall 3005 in the section 3006 drilled into an earth formation.

Hereby it is possible to the apparatus to seal efficiently against the wall 3005 of the drilled section 3006. The bag or bellows 3003 is able to increase the outer diameter of the apparatus by up to more than twice the outer diameter of the cage in expanded configuration.

In further an embodiment of an apparatus 3000 for sealing off a part of a wall 3005 in a section 3006 drilled into an earth formation and to be placed in the section 3006 drilled into the earth formation, elongate members 3001 is provided with ends sloping in a direction against the wall 3005 of the section 3006 drilled into an earth formation. Hereby is acquired passage for devices and further apparatuses i.e. to seal an area further down the drilled section 3006. The sloping ends will then act like a kind of funnel directing equipment through the passage formed by the inner diameter of the apparatus.

In yet an embodiment of an apparatus 3000 for sealing off a part of a wall 3005 in a section 3006 drilled into an earth formation and to be placed in the section 3006 drilled into the earth formation, the apparatus is brought into applied position by inflating a bag or bellows 3008 arranged along the inner diameter of the apparatus formed by the elongate members 3001 connected with the intermediate links 3002. This makes it possible to use an available kind of fluid to inflate the bag or bellows 3008 and thereby bringing the apparatus into applied position. Further it is possible to achieve a higher pressure using water or another fluid in stead of a gas or simply atmospheric air. It is possible to use gas or air, but a liquid fluid is able to achieve higher pressure.

Examples of available fluids can be fluid from the section 3006 drilled in the earth formation or a fluid carried in a running tool 3010.

Alternatively any fluid or gas or epoxy or foam can be used to fill the outer bag or bellows 3003.

In an embodiment of an apparatus 3000 for sealing off a part of a wall 3005 in a section 3006 drilled into an earth formation and to be placed in the section 3006 drilled into the earth formation, the intermediate links 3002 in unlocked position can be moved in a plane in the longitudinal direction of the elongate members 3001, thereby making it possible to expand a kind of cage of elongate members 3001 by means of intermediate links 3002.

In another embodiment of an apparatus 3000 for sealing off a part of a wall 3005 in a section 3006 drilled into an earth formation and to be placed in the section 3006 drilled into the earth formation, the intermediate links 3002 in unlocked position can be moved in a plane substantially perpendicular to the longitudinal direction of the elongate members 3001 makes it possible to make a more tight curve of the elongate members 3001.

By having an apparatus 3000 as described above and below, it is possible to apply the apparatus in any geometry of a section 3006 drilled into an earth formation.

The apparatus 3000 acquires due to its configuration a reliable collapse resistance, thereby making it possible to maintain an applied sealing using the apparatus.

When an apparatus 3000 is installed, it will still be possible to allow passage of another or further apparatuses which can be set beyond the apparatus passed.

It is possible to manufacture the apparatus 3000 of almost any length. The only limitation is the maximum running length, determined by the wireline lubricator length.

It is also possible to position apparatuses 3000 closely next to each other.

An apparatus 3000 can be disabled by simply punching a hole in the outer bag or bellows 3003.

The apparatus 3000 can be provided with an arrangement for deflating the outer bag or bellows 3003 by punching a hole in the bag or bellows 3003 or by deflating the bag or bellows 3003 by letting out the media enclosed in the bag or bellows 3003, i.e. through a valve or another kind of closable opening 3009.

This is achieved by having an apparatus 3000 for sealing off a part of a wall 3005 in a section 3006 drilled into an earth formation and to be placed in the section 3006 drilled into the earth formation, said apparatus comprising a number of elongate members 3001 arranged substantially parallel along a closed curve, where adjacent elongate members 3001 are connected via a number of intermediate links 3002, each link 3002 being moveable relative to the elongate members 3001 it is attached to from an unlocked position to a locked position.

An apparatus 3000 for sealing off a part of a wall 3005 in a section 3006 drilled into an earth formation and to be placed in the section 3006 drilled into the earth formation, where the length of the intermediate links 3002 and the number of elongate members 3001 are adapted to form an outer diameter of the apparatus in collapsed state, which outer diameter is smaller than the inner diameter of the apparatus being in an activated state, makes it possible to introduce a collapsed apparatus into the section 3006 drilled into an earth formation through an already positioned apparatus.

Further it makes it possible to introduce the apparatus 3000 through the tubing and into the well.

An apparatus 3000 for sealing off a part of a wall 3005 in a section 3006 drilled into an earth formation and to be placed in the section 3006 drilled into the earth formation, where the elongate members 3001 are provided with locking means for holding the intermediate links 3002 in a position substantially perpendicular to the elongate members 3001, provides a kind of stiff cage in expanded configuration. When the intermediate links 3002 are in locked position, meaning that they can not be moved in such a way that the distance between two neighbouring or two adjacent elongate members 3001 are reduced, they will provide the apparatus with a minimum collapse strength of the deployed device.

In an embodiment of the patch-type apparatus the material from which the intermediate link members are selected has a minimum of collapse strength of the deployed device in excess of 35 bars.

In another embodiment of the patch-type apparatus the whole assembly can run on coil tubing (2" OD), small drill pipe (3½" OD) or tractor. The apparatus can be equipped with one or more electric cables or batteries to make it possible to use electric current as an energy source.

In an embodiment a hydraulic pump (not shown) can provide the apparatus with well fluids (oil, water or a mixture) via a filter to inflate up the outer bag or bellows 3003. A similar arrangement comprising a hydraulic pump 3017, a filter 3018 and a fluid inlet 3019 may be used to inflate the inner bag or bellows 3008 to expand the net as shown in FIG. 27.

When inflating the outer bag or bellows 3003 a valve 3009 can be used. When the valve 3009 is connected to the apparatus a spring activated 3011 shear pin 3012. The shear pin 3012 will fail at a predetermined internal pressure and a flexible steel pipe 3013 will be 'pushed' out by that pressure. The valve 3009 is provided with a reinforcement 3015 extending into the inner bellows 3008 so that the valve will not detach from the inner bellows 3008.

After the full expansion pressure is achieved, more pressure is applied to detach the hydraulic line 3013 of the running tool 3010 from the external bag or bellows 3003. A back flow valve 3014 together with the shear pin 3012 ensures that a certain pressure is achieved and that the fluid pressure will not decrease in the bag or bellows 3003 when the hydraulic line 3013 is detached.

When the pressure is increased and the shear pin 3012 is sheared, the inner bag or bellows 3008 is deflated and the running tool 3010 is then retracted.

The running tool 3010 with a patch 3000 mounted thereon may be advanced through a wellbore by means of a tractor 2100 as described above. The running tool 3010 is provided with a rod 3016 adapted to be releasably connected to the tractor 2100, see FIG. 27. FIGS. 31 and 32 show the running tool 3010 connected to the tractor 2100 by means of the rod 3016. The running tool 3010 may further comprise an electric connection 3020 and a wire-line connector 3021, see FIG. 27.

A method for applying an apparatus 3000 for sealing off a part of a wall 3005 in a section 3006 drilled into an earth formation comprises the steps of:

- positioning an apparatus for sealing off a part of a wall 3005 in a section 3006 drilled into an earth formation with respect to a part of the wall 3005 to be sealed of, the apparatus being positioned in collapsed configuration;
- expanding a net or cage in the apparatus, which net or cage is formed by a number of elongate members 3001 connected by intermediate links 3002;
- expanding a flexible member 3003 arranged at an outer diameter of the apparatus to seal against the wall 3005 in the section 3006 drilled in the earth formation.

The method further describes an embodiment where a further apparatus for sealing off a part of a wall 3005 in a section 3006 drilled into an earth formation is introduced in collapsed configuration through an inner diameter of an already deployed apparatus.

The foregoing descriptions of embodiments of the invention have been presented for the purpose of illustration and description only. They are not intended to be exhaustive or to limit the invention to the forms disclosed. Accordingly, many modifications and variations will be apparent to the practitioners skilled in the art. Additionally, the above disclosure is not intended to limit the invention. The scope of the invention is defined by the appended claims.

In another embodiment of the method a further apparatus for sealing off a part of a wall 3005 in a section 3006 drilled into an earth formation is introduced in collapsed configuration through a tubing further downhole the drilled section than an already deployed apparatus.

In general, any of the technical features and/or embodiments described above and/or below may be combined into one embodiment. Alternatively or additionally any of the technical features and/or embodiments described above and/or below may be in separate embodiments. Alternatively or additionally any of the technical features and/or embodiments described above and/or below may be combined with any number of other technical features and/or embodiments described above and/or below to yield any number of embodiments.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A method to facilitate well management in open hole completions being equipped with a production tubing, said method comprising the steps of:

advancing a data acquisition module having a propulsion system through the production tubing and further into an open hole section of a wellbore and acquiring data providing information about the shape, size and surface condition and revealing fractures in a wall of the open hole section of the wellbore, and whereby at least one blocking system, on the basis of the data acquired, in the open hole wellbore, is placed at a location of a fracture in the wall, wherein the data acquisition module is advanced by interaction with a fluid present in the wellbore, and by that the data acquisition module acquires data providing information on a position of the data acquisition module in relation to the wall of the wellbore and is controlled on the basis of said data in order to maintain a distance to the wall of the wellbore during advancement of the data acquisition module.

2. The method for well and reservoir management in open hole completions according to claim 1, wherein the data acquisition module is advanced through the wellbore a first and a second time, and by that during the second time of advancement, the data acquisition module is advanced through at least one blocking system placed in the wellbore.

3. The method for well and reservoir management in open hole completions according to claim 1, wherein the data acquisition module is advanced in the wellbore at least partly by the fluid present in wellbore as the fluid flows through the wellbore.

4. The method for well and reservoir management in open hole completions according to claim 1, wherein the data acquisition module is advanced in the wellbore at least partly by means of a propulsion device incorporated into the data acquisition module.

5. The method for well and reservoir management in open hole completions according to claim 1, wherein controlled radial movement of the data acquisition module relative to the wellbore is established at least partly by means of at least one propeller or at least one jet stream.

6. The method for well and reservoir management in open hole completions according to claim 1, wherein controlled vertical movement of the data acquisition module relative to the wellbore is established at least partly by a variable buoyancy system incorporated into the data acquisition module.

7. The method for well and reservoir management in open hole completions according to claim 1, wherein data providing information revealing the position along the wellbore of the fracture in the wall of the wellbore is communicated wirelessly to a control module outside the wellbore, and by that the at least one blocking system is placed in the wellbore at the location of the fracture in the wall on the basis of the data received by said control module.

8. The method for well and reservoir management in open hole completions according to claim 1, wherein a sound signal is communicated between the data acquisition module and a control module located outside the wellbore, whereby the sound signal is transmitted through the fluid present in the wellbore, and by that the position of the fracture in the wall of the wellbore is determined at least on the basis of said sound signal received by the control module or by the data acquisition module and at least on the basis of a time difference between the time of emission of the sound signal and the time of reception of the sound signal.

9. The method for well and reservoir management in open hole completions according to claim 1, wherein data providing information revealing the position along the wellbore of the fracture in the wall of the wellbore is communicated outside the wellbore by means of a radio-frequency identification (RFID) tag released by the data acquisition module, conveyed by the fluid present in the wellbore and collected outside the wellbore.

10. The method for well and reservoir management in open hole completions according to claim 1, wherein the at least one blocking system, on the basis of at least the data acquired by the data acquisition module, is placed in the wellbore at the location of the fracture in the wall by means of a well tractor.

11. The method for well and reservoir management in open hole completions according to claim 10, wherein a sound signal is communicated between the well tractor and a control module located outside the wellbore, whereby the sound signal is transmitted through the fluid present in the wellbore, and by that the position of the well tractor is determined at least on the basis of said sound signal received by the control module or by the well tractor and at least on the basis of a time difference between the time of emission of the sound signal and the time of reception of the sound signal.

12. The method for well and reservoir management in open hole completions according to claim 10, wherein the well tractor pulls the at least one blocking system in the form of a patch through the wellbore to the location of the fracture in the wall, whereby the patch is expanded until abutment against the wall of the wellbore and released from the well tractor.

13. The method for well and reservoir management in open hole completions according to claim 12, wherein the well tractor advances through a first patch already expanded and fixed in the wellbore and pulls a second patch through the first patch.

14. The method for well and reservoir management in open hole completions according to claim 1, wherein the data acquisition module advances through a first part of the wellbore in order to reach a second part of the wellbore, by that the at least one blocking system is placed in the second part of the wellbore, and by that the first part of the wellbore has a diameter that is smaller than, and preferably less than the half of, the diameter of the second part of the wellbore.

15. A method of producing crude oil comprising a method for well and reservoir management in open hole completions according to claim 1.

16. A system for well and reservoir management in open hole completions, the system comprising:

a data acquisition module configured to be advanced through a wellbore and configured to acquire data providing information revealing fractures in a wall of the wellbore, and the system comprising at least one blocking system; and a tool configured to, on the basis of the data acquired, place the at least one blocking system in the wellbore at a location of a fracture in the wall, wherein the data acquisition module is configured to be advanced by interaction with the fluid present in the wellbore, and in that the data acquisition module is configured to acquire data providing information on a position of the data acquisition module in relation to the wall of the wellbore and is configured to be controlled on the basis of said data in order to maintain a distance to the wall of the wellbore during advancement of the data acquisition module.

17. The system for well and reservoir management in open hole completions according to claim 16, wherein the at least one blocking system has the form of a patch configured to be expanded from a collapsed state to an expanded state for abutment against the wall of the wellbore and fixation in the wellbore, and in that the data acquisition module has a maximum outer diameter that is smaller than a minimum inner diameter of the at least one patch in its expanded state.

18. The system for well and reservoir management in open hole completions according to claim 16, wherein the data acquisition module is configured to be advanced in the wellbore at least partly by means of movement of fluid flowing through the wellbore.

19. The system for well and reservoir management in open hole completions according to claim 16, wherein the data acquisition module comprises a propulsion device.

20. The system for well and reservoir management in open hole completions according to claim 16, wherein the data acquisition module comprises at least one propeller or at least one jet stream configured for controlled radial movement of the data acquisition module relatively to the wellbore.

21. The system for well and reservoir management in open hole completions according to claim 16, wherein the data acquisition module comprises a variable buoyancy system configured for controlled vertical movement of the data acquisition module relative to the wellbore.

22. The system for well and reservoir management in open hole completions according to claims 16, wherein the system comprises a control module configured to be located outside the wellbore and configured to receive wirelessly communicated data providing information revealing the position along the wellbore of the fracture in the wall of the wellbore, and in that the system comprises a tool configured to place the at least one blocking system in the wellbore at the location of the fracture in the wall on the basis of the data received by said control module.

23. The system for well and reservoir management in open hole completions according to claim 16, wherein the system comprises a control module configured to be located outside the wellbore, in that the system is configured to communicate a sound signal between the data acquisition module and the control module, whereby the sound signal is transmitted through the fluid present in the wellbore, and in that the system is configured to determine the position of the fracture in the wall of the wellbore at least on the basis of said sound signal received by the control module or by the data acquisition module and at least on the basis of a time difference between the time of emission of the sound signal and the time of reception of the sound signal.

24. The system for well and reservoir management in open hole completions according to claim 16, wherein the data acquisition module is configured to carry a number of radio-frequency identification (RFID) tags, to code said radio-frequency identification tags with data providing information revealing the position along the wellbore of the fracture in the wall of the wellbore, and to release said radio-frequency identification tags one by one during advancement of the data acquisition module through the wellbore.

25. The system for well and reservoir management in open hole completions according to claim 16, wherein the tool configured to place the at least one blocking system in the wellbore is a well tractor.

26. The system for well and reservoir management in open hole completions according to claim 25, wherein the system is configured to communicate a sound signal between the well tractor and a control module located outside the wellbore, whereby the sound signal is transmitted through the fluid present in the wellbore, and in that the system is configured to determine the position of the well tractor at least on the basis of said sound signal received by the control module or by the well tractor and at least on the basis of a time difference between the time of emission of the sound signal and the time of reception of the sound signal.

27. The system for well and reservoir management in open hole completions according to claim 25, wherein the well tractor is configured to pull the at least one blocking system in the form of a patch through the wellbore to the location of the fracture in the wall, and in that the system is configured to expand the patch until abutment against the wall of the wellbore and to release the patch from the well tractor.

28. The system for well and reservoir management in open hole completions according to claim 25, wherein the system comprises at least a first and a second patch, and in that the well tractor is configured to advance through the first patch already being expanded and fixed in the wellbore and to subsequently pull the second patch through the first patch.

29. A system for well and reservoir management in open hole completions according to claim 16, wherein the system comprises a tubing configured to form a first part of a wellbore, said wellbore having a second part with a diameter that is larger than, and preferably more than twice, the diameter of the first part, and in that the data acquisition module is configured to advance through said tubing forming the first part of the wellbore in order to reach the second part of the wellbore and advance through the second part of the wellbore.

30. A system for producing crude oil comprising a system for well and reservoir management in open hole completions according to claim 16.

* * * * *